US006444387B2

(12) United States Patent
Ri et al.

(10) Patent No.: US 6,444,387 B2
(45) Date of Patent: Sep. 3, 2002

(54) IMAGE BEARING MATERIAL, ELECTROPHOTOGRAPHIC PHOTORECEPTOR USING THE IMAGE BEARING MATERIAL, AND IMAGE FORMING APPARATUS USING THE PHOTORECEPTOR

(75) Inventors: Kohkoku Ri; Masaomi Sasaki; Kazukiyo Nagai; Shinichi Kawamura, all of Shizuoka-ken (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 09/742,985

(22) Filed: Dec. 22, 2000

(30) Foreign Application Priority Data

| | | |
|---|---|---|
| Dec. 24, 1999 | (JP) | 11-367869 |
| May 17, 2000 | (JP) | 2000-145652 |
| Aug. 4, 2000 | (JP) | 2000-236849 |

(51) Int. Cl.[7] ..... G03G 5/147
(52) U.S. Cl. ..... 430/67; 430/128
(58) Field of Search ..... 430/66, 67, 126, 430/58.7

(56) References Cited

U.S. PATENT DOCUMENTS

| | | | | |
|---|---|---|---|---|
| 4,716,091 A | * | 12/1987 | Yoshihara et al. | 430/66 |
| 4,772,525 A | | 9/1988 | Badesha et al. | |
| 4,801,517 A | | 1/1989 | Frechet et al. | |
| 4,806,444 A | | 2/1989 | Yanus et al. | |
| 4,818,650 A | | 4/1989 | Limburg et al. | |
| 5,030,532 A | | 7/1991 | Limburg et al. | |
| 5,155,200 A | | 10/1992 | Limburg et al. | |
| 5,344,985 A | | 9/1994 | Tanaka et al. | |
| 5,356,743 A | | 10/1994 | Yanus et al. | |
| 5,370,954 A | | 12/1994 | Ohta et al. | |
| 5,457,232 A | | 10/1995 | Tanaka et al. | |
| 5,459,275 A | | 10/1995 | Tanaka et al. | |
| 5,492,784 A | | 2/1996 | Yoshikawa et al. | |
| 5,576,132 A | | 11/1996 | Tanaka et al. | |
| 5,578,405 A | | 11/1996 | Ikegami et al. | |
| 5,587,516 A | | 12/1996 | Tanaka et al. | |
| 5,599,995 A | | 2/1997 | Tanaka et al. | |
| 5,604,065 A | | 2/1997 | Shimada et al. | |
| 5,616,805 A | | 4/1997 | Tanaka et al. | |
| 5,670,283 A | * | 9/1997 | Kato et al. | 430/66 |
| 5,672,728 A | | 9/1997 | Tanaka et al. | |
| 5,672,756 A | | 9/1997 | Shimada et al. | |
| 5,942,363 A | | 8/1999 | Tanaka et al. | |
| 5,981,124 A | | 11/1999 | Shimada et al. | |
| 6,093,784 A | | 7/2000 | Tamura et al. | |
| 6,103,435 A | | 8/2000 | Shimada et al. | |

FOREIGN PATENT DOCUMENTS

| | | |
|---|---|---|
| JP | 51-73888 | 6/1976 |
| JP | 54008527 | 1/1979 |
| JP | 54011737 | 1/1979 |
| JP | 56150749 | 11/1981 |
| JP | 57078402 | 5/1982 |
| JP | 60177349 | 9/1985 |
| JP | 63065449 | 3/1988 |
| JP | 02143257 | 6/1990 |
| JP | 02144550 | 6/1990 |
| JP | 03050555 | 3/1991 |
| JP | 04175337 | 6/1992 |
| JP | 05310904 | 11/1993 |
| JP | 07128872 | 5/1995 |
| JP | 07295248 | 11/1995 |
| JP | 07301936 | 11/1995 |
| JP | 8-30102 | 3/1996 |
| JP | 08082940 | 3/1996 |
| JP | 08190213 | 7/1996 |
| JP | 10254160 | 9/1998 |
| JP | 11181214 | 7/1999 |
| JP | 2000010322 | 1/2000 |

* cited by examiner

*Primary Examiner*—John Goodrow
(74) *Attorney, Agent, or Firm*—Oblon, Spivak, McClelland, Maier & Neustadt, P.C.

(57) ABSTRACT

An image bearing material including a matrix resin and, within the matrix resin, a core/shell graft copolymer including a core including one or more polymers and a shell including a graft polymer which has a linear chain connected with the core and which is formed from one or more monomers. The image bearing material is preferably used for a surface layer of an electrophotographic photoreceptor, an intermediate transfer medium, and the like image bearing members to improve the abrasion resistance thereof.

50 Claims, 8 Drawing Sheets

IMAGE BEARING MATERIAL, ELECTROPHOTOGRAPHIC PHOTORECEPTOR USING THE IMAGE BEARING MATERIAL, AND IMAGE FORMING APPARATUS USING THE PHOTORECEPTOR

BACKGROUND OF THE INVENTION

1. Field of the Invention

The present invention relates to an image bearing material, an electrophotographic photoreceptor using the image bearing material, and an image forming apparatus using the photoreceptor. More particularly, the present invention relates to an electrophotographic photoreceptor including a graft copolymer having a core/shell structure as an image bearing material, and an image forming apparatus using the photoreceptor.

2. Discussion of the Background

Electrophotographic image forming methods used for copiers, facsimile machines, laser printers, direct digital print-plate making machines etc. are well known. The image forming methods typically include the following processes:

(1) charging an electrophotographic photoreceptor (charging process);

(2) irradiating the charged photoreceptor with light to form an electrostatic latent image thereon (light irradiating process);

(3) developing the latent image with a toner to form a toner image thereon (developing process);

(4) optionally transferring the toner image on an intermediate transfer medium (transfer process);

(5) transferring the toner image onto a receiving material such as a transfer paper (transfer process);

(6) fixing the toner image to form a fixed toner image (fixing process); and (7) cleaning the surface of the photoreceptor (cleaning process).

Until now, photoreceptors in which an inorganic material such as selenium, a selenium alloy or an amorphous silicone is formed on an electroconductive substrate as a photosensitive layer, or photoreceptors having a photosensitive layer in which an inorganic photoconductive material such as zinc oxide, cadmium sulfide or the like is dispersed in a binder resin have been used as photoreceptors for the electrophotographic image forming apparatus. Currently, photoreceptors using organic photosensitive materials are widely used because of having the following advantages over the above-mentioned photoreceptors:

(1) manufacturing costs are relatively low;

(2) it is easy to design a photoreceptor having a desired property; and (3) hardly causing environmental pollution.

As the organic photoreceptors, the following photoreceptors are known:

(1) photoreceptors having a photosensitive layer including a photosensitive resin such as polyvinyl carbaozole (PVK) or the like material;

(2) photoreceptors having a photosensitive layer including a charge transfer complex such as polyvinyl carbaozole (PVK)/trinitrofluorenone (TNF) or the like material;

(3) photoreceptors having a photosensitive layer including a pigment, such as phthalocyanine or the like, dispersed in a binder resin; and (4) photoreceptors having a functionally-separated photosensitive layer using a charge generation material and a charge transport material.

Among these organic photoreceptors, the photoreceptors having a functionally-separated photosensitive layer especially attract attention now.

The mechanism of forming an electrostatic latent image in a functionally-separated photosensitive layer having a charge generation layer and a charge transport layer is as follows:

(1) when the photosensitive layer is exposed to light after the layer is charged, the light passes through the transparent charge transport layer and then reaches the charge generation layer;

(2) the light is absorbed by the charge generation material included in the charge generation layer;

(3) the charge generation material generates a charge carrier such as electrons and positive holes;

(4) the charge carrier is injected to the charge transport layer;

(5) the charge carrier is transported through the charge transport layer due to the electric field formed by the charging;

(6) the charge carrier finally reaches the surface of the photosensitive layer and neutralizes the charge thereon, resulting in formation of an electrostatic latent image.

In the functionally-separated photoreceptors, a combination of a charge transport material mainly absorbing light having a wavelength in an ultraviolet region and a charge generation material mainly absorbing light having a wavelength in a visible region is typically used.

Until now, low molecular weight charge transport materials have been mainly developed and used. Since low molecular weight compounds have poor film forming ability when used alone, the compounds are typically used together with an inactive polymer while being dispersed therein. The charge transport layer constituted of a low molecular weight charge transport material and an inactive polymer is typically soft. Therefore, the photoreceptor having such a charge transport layer has a drawback such that when repeatedly used in electrophotographic processes, the charge transport layer is easily abraded due to the mechanical stresses applied thereto in the developing process and cleaning process.

In addition, such a charge transport layer has a relatively low charge mobility, and therefore it is difficult to design a high speed electrophotographic image forming apparatus or a small-sized image forming apparatus. This is because the concentration of the low molecular weight charge transport material is not greater than 50% in the charge transport layer. When the concentration of the low molecular weight charge transport material is greater than 50%, the film formability and abrasion resistance of the resultant charge transport layer seriously deteriorate.

In attempting to solve such a problem, Japanese Laid-Open Patent Publication (hereinafter "JOP") No. 5-216250 discloses a photoreceptor using an improved binder resin. However, the abrasion resistance cannot dramatically improved because a charge transport material is included in the layer in an amount of about 50%.

In addition, JOPs Nos. 51-73888, 54-8527, 54-11737, 56-150749, 57-78402, 63-285552, 64-1728, 64-13061, 64-19049, 3-50555, 4-175337, 4-225014, 4-230767, 5-232727, and 5-310904 have disclosed polymers having a charge transport ability. The life of a photoreceptor can be extended to some extent by using such a charge transport polymer. However, the life is not satisfactory because when used in an image forming apparatus, the photoreceptor has to be changed at regular intervals due to the abrasion of the photosensitive layer.

JOPs Nos. 07-295248, 07-301936 and 08-082940 have disclosed photoreceptors in which a fluorine-containing silicone oil is included in their surface layer to improve the cleaning property of the layer and the abrasion resistance of the photoreceptors. However, a fluorine-containing silicone oil tends to migrate to the surface portion of the surface layer. When the photoreceptor is repeatedly used, the surface portion is easily abraded, and therefore the effect of the silicone oil disappears. Therefore, the life of the photoreceptor cannot be not extended.

Further, photoreceptors in which a particulate filler is included in the photosensitive layer to improve their abrasion resistance have been disclosed. For example, a particulate silicone resin or fluorine-containing resin (JOP No. 63-65449) and a particulate melamine resin (JOP No. 60-177349) have been disclosed. In addition, JOPs Nos. 02-143257, 02-144550, 07-128872 and 10-254160 have disclosed techniques in which a polyethylene powder (02-143257), a fluorine-containing powder (02-144550) or a particulate silicone oil (07-128872 and 10-254160) is included in a surface layer to decrease the coefficient of friction of the surface layer and to improve the abrasion resistance as a result of improvement of the cleaning property of the surface layer.

In addition, techniques in which a crosslinked organic particulate material (JOP No. 2000-010322 and U.S. Pat. No. 5,998,072), or a methylsiloxane resin powder (JOP No. 08-190213) is included in a surface layer to decrease the coefficient of friction of the surface layer and to improve the abrasion resistance as a result of improvement of the cleaning property of the surface layer.

These techniques intend to improve the abrasion resistance of the photoreceptor by decreasing the coefficient of friction or surface energy of the surface of the photosensitive layer.

However, the photoreceptors have the following drawbacks:

(1) the resin powders and particulate resins typically have poor compatibility with a binder resin used in the surface layer, and therefore the resin powders are not dispersed well in the surface layer, resulting in formation of undesired images such as black spots image or white spots;

(2) when repeatedly used, the residual potential of the photoreceptor increases, resulting in formation of image having low image density or background development; and (3) the transmission of light through the photosensitive layer is obstructed, resulting in deterioration of photosensitivity and charge transporting ability, and thereby undesired images having uneven image density tend to be produced.

Because of these reasons, a need exists for a photoreceptor having a high photosensitivity and good abrasion resistance.

SUMMARY OF THE INVENTION

Accordingly, an object of the present invention is to provide an image bearing material having good abrasion resistance which can be used for an electrophotographic photoreceptor, and an intermediate transfer belt, a fixing belt and the like medium for use in the image forming apparatus.

Another object of the present invention is to provide an electrophotographic photoreceptor having a combination of good photosensitivity and good abrasion resistance.

Yet another object of the present invention is to provide image forming apparatus which can produce images having good image qualities at a high speed without frequently changing a photoreceptor.

Briefly these objects and other objects of the present invention as hereinafter will become more readily apparent can be attained by an image bearing material including a matrix resin and, within the matrix resin, a graft copolymer having a core/shell structure which includes a core including one or more polymers and a shell including a polymer which has a linear chain structure connected with the core and which is formed from one or more monomers. The shell may have a linear structure having a polar group. In addition, the shell may be constituted of two or more layers.

The core preferably includes a complex polymer in which two or more polymers are intertwined such that the polymers cannot be separated from the other and the shell is formed from one or more vinyl monomers. Alternatively, the core material may be a complex polymer including two or more polymers having network structures which invade each other.

The complex polymer preferably includes at least a polyorganosiloxane.

In another aspect of the present invention, an electrophotographic photoreceptor is provided which includes an electroconductive substrate, and a photosensitive layer formed on the substrate and including the image bearing material mentioned above. The core/shell graft polymer is preferably included in the surface layer of the photoreceptor. Alternatively the photosensitive layer may include a charge generation layer and a charge transport layer, wherein the core/shell graft polymer is included in the surface layer.

In yet another aspect of the present invention, an image forming apparatus is provided which includes the electrophotographic photoreceptor of the present invention as an image bearing member.

In a further aspect of the present invention, a process cartridge is provided which can be attached to or detached from an electrophotographic image forming apparatus and which includes the photoreceptor of the present invention and at least a device selected from the group consisting of a charging device, a light irradiating device, a developing device, a transfer device and a cleaning device.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
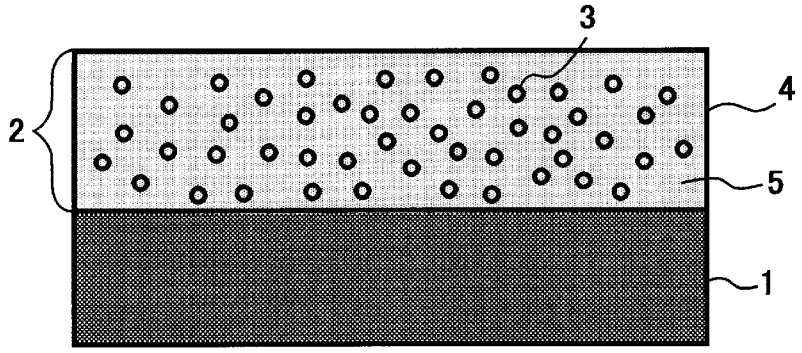
FIGS. 1–7 are schematic views illustrating the cross sections of embodiments of the electrophotographic photoreceptor of the present invention.

Generally, the present invention provides an image bearing material including a matrix resin and, within the matrix resin, a graft copolymer having a core/shell structure which includes a core including one or more polymers and a shell including a polymer which has a linear chain structure connected with the core and which is formed from one or more monomers. In the graft polymer having a core/shell structure (hereinafter referred to as the core/shell graft copolymer), it is preferable that the core is mainly constituted of a rubber like material including one or more polymers and the shell is mainly constituted of a layer which is formed by graft-polymerizing one or more vinyl monomers with the core.

The resin compositions having a core/shell structure are disclosed in JOP No. 11-181214 (Applicant: Asahi Chemical Industry co., Ltd.).

The core/shell graft copolymers for use in the present invention will be explained in detail.

Suitable materials for use as the core in the core/shell graft polymers include polybutadiene, styrene-butadiene block copolymers, styrene-butadiene random copolymers, acrylonitrile-butadiene block copolymers, saturated rubbers which are prepared by hydrogenating or partially hydrogenating the above-mentioned diene polymers, isoprene rubbers, chloroprene rubbers, natural rubber, silicone rubbers, ethylene-propylene-diene terpolymers, acrylic rubbers, acrylic-silicone complex rubbers and the like rubbers. These rubbers (polymers) can be used alone or in combination.

Among these materials, the acrylic-silicone complex rubbers (polymers) are especially preferable.

The core polymer is preferably prepared by an emulsion polymerization. In addition, a crosslinkable monomer may be used to prepare the core polymer. Suitable crosslinkable monomers include aromatic divinyl compounds such as divinyl benzene; alkanepolyol poly(meth)acrylates such as ethyleneglycol diacrylate, and ethyleneglycol dimethacrylate; and allyl compounds such as allyl methacrylate.

The acrylic-silicone complex rubbers mentioned above are defined as complex polymers in which a polyorganosiloxane component and a polyalkyl (meth)acrylate component are intertwined such that the components cannot be separated from the other.

Specifically, the acrylic-silicone complex polymers can be prepared, for example, by the following method:

(1) a polyorganosiloxane latex is prepared by emulsion-polymerizing a ring organosiloxane having three or more silicon atoms such as hexamethyl cyclotrisiloxane, octamethyl cyclotetrasiloxane, and decamethyl cyclopentasiloxane using a crosslinking agent and/or a graft crossing agent which can make molecular chains intertwined;

(2) an alkyl (meth)acrylate monomer, a crosslinking agent and a graft crosslinking agent are mixed with the polyorganosiloxane latex such that the latex is impregnated with the acrylate monomer, crosslinking agent and graft crossing agent; and (3) the mixture is polymerized.

Suitable alkyl (meth)acrylate for use in the step (2) mentioned above include alkyl acrylates such as methyl acrylate, ethyl acrylate, n-propyl acrylate, n-butyl acrylate, and 2-ethylhexyl acrylate; and alkyl methacrylates such as hexyl methacylate and 2-ethylhexyl methacrylate. Among these alkyl (meth)acrylates, n-butyl acrylate is preferable.

When the acrylic-silicone complex polymers are prepared, the content of each of the acrylic component and the silicone component in the complex polymer is preferably from 10 to 90% by weight, and more preferably from 20 to 80% by weight. When the content of the polyorganosiloxane rubber component is too high, the external appearance of the image bearing material which is prepared by coating a mixture of the resultant graft copolymer with a matrix resin deteriorates. On the contrary, the content of the polyalkyl (meth)acrylate component is too high, the abrasion resistance and impact resistance of the resultant graft copolymer deteriorate.

The average particle diameter of the core polymer (i.e., the complex polymer) is preferably from 0.01 to 1.0 $\mu$m, and more preferably from 0.08 to 0.6 $\mu$m. When the average particle diameter is too small, the abrasion resistance and impact resistance of the resultant graft polymer deteriorate. On the contrary, when the average particle diameter is too large, not only the abrasion resistance and impact resistance of the resultant graft polymer deteriorate, but also the external appearance of the image bearing material which is prepared by coating a mixture of the resultant graft copolymer with a matrix resin deteriorates.

The manufacturing method of the acrylic-silicone complex rubbers mentioned above is described in detail in Japanese patent Publication (hereinafter "JPP") No.8-30102 (Applicant: Mitsubishi Rayon Co., Ltd.).

The thus prepared core polymer is then graft-polymerized with one or more vinyl monomers by a radical polymerization method. The radical polymerization may be preformed by one or more steps. Thus, a graft copolymer having a core/shell structure for use in the present invention is prepared. The graft copolymer may include a free polymer and/or a free copolymer which are byproducts constituted of the one or more vinyl monomers used for graft copolymerization and which are not grafted with the core.

Suitable vinyl monomers for use as a shell material (i.e., a material to be graft-polymerized with such a core material) include aromatic vinyl compounds such as styrene, $\alpha$-methyl styrene, methyl(o-, m-, p-)styrene, ethyl styrene, isobutyl styrene, t-butyl styrene, bromostyrene, and vinyl naphthalene; vinyl cyanides such as acrylonitrile and methacrylonitrile; alkyl methacrylates such as methyl methacrylate, 2-ethylhexyl methacrylate, ethyl methacrylate, propyl methacrylate, hydroxyethyl methacrylate, cyclohexyl methacrylate, and butyl methacrylate; alkyl acrylates such as methyl acrylate, ethyl acrylate, and butyl acrylate; and the like compounds. These compounds are used alone or in combination.

In order to form an image bearing material having good light transmittance which includes a matrix resin and a graft copolymer, the shell material is selected from the above-mentioned compounds depending on the polarity of the matrix resin. Namely, when a polar matrix resin is used, a polar compound is preferably selected as the shell material because of having good compatibility with the matrix resin. On the contrary, when a nonpolar matrix resin is used, a nonpolar compound is preferably selected as the shell material.

In the present invention, it is preferable to polymerize one or more vinyl monomers with the above-mentioned acrylic-silicone complex rubber (i.e., the core) by one or more steps using a radical polymerization method, to prepare a complex core/shell copolymer. When such a complex core/shell copolymer is used in the image bearing material, the resultant image bearing material has good abrasion resistance and impact resistance. This complex core/shell copolymer can be prepared by a method similar to the above-mentioned method. The method is described in detail in JPP No.8-30102 (Applicant: Mitsubishi Rayon Co., Ltd.).

The core/shell graft copolymer for use in the present invention and the core thereof preferably have a low coefficient of friction (namely, low surface energy) and/or an elasticity.

The ratio of the core layer (the acrylic-silicone complex rubber) to the shell layer (the vinyl monomers) is preferably from 30/70 to 95/5 by weight, and more preferably from 40/60 to 90/10 by weight. When the content of the shell layer in the core/shell graft copolymer is too low, the dispersibility of the core/shell graft polymer in the matrix resin is not satisfactory. On the contrary, the content of the shell layer is too high, the impact resistance of the resultant image bearing material (i.e., the mixture of the graft copolymer and the matrix resin) deteriorates.

The average particle diameter of the core/shell graft copolymer is preferably from 0.05 to 5 $\mu$m. When the average particle diameter is too small, the abrasion resistance and impact resistance of the resultant image bearing material are not satisfactory. On the contrary, when the average particle diameter is too large, the outer appearance of the resultant image bearing material deteriorates, and in addition improvement of the abrasion resistance and impact resistance thereof is not satisfactory.

When an emulsifier, a flocculent and the like are used for preparing the core/shell graft copolymer, the materials are preferably removed therefrom because the materials tend to deteriorate the electrostatic properties of the resultant photoreceptor. As the removing method of the materials, treatments in which the graft copolymers are treated with an acid, an alkaline solution, water (deionized water) or an alcohol; and solid-liquid extraction methods such as Soxhlet extraction methods and the like can be used.

The core/shell graft copolymer is preferably subjected to a washing treatment using deionized water to an extent such that the electroconductivity of the deionized water used for washing is not greater than 5.0 $\mu$s/cm. In addition, the contents of elements of sodium, calcium and barium are preferably not greater than 100 ppm, respectively.

The content of this core/shell graft copolymer in the image bearing material depends on the species of the matrix resin used; the desired external appearance, abrasion resistance and impact resistance of the image bearing material; and the application of the image bearing material. When the image bearing material is used for the photosensitive layer of an electrophotographic photoreceptor, the content of the graft copolymer in the photosensitive layer is preferably not greater than 20% by weight, and more preferably not greater than 10% by weight. When the content is too high, the surface smoothness of the photoreceptor deteriorates, and in addition the residual potential of the photoreceptor increases, resulting in deterioration of image density and formation of background development.

Suitable methods of adding the core/shell graft copolymer to a matrix resin include methods in which the graft copolymer and the matrix resin are mixed and agitated in a solvent; dispersing methods in which the graft copolymer is mixed with the matrix resin and dispersed using one of ball milling methods, vibration milling methods and supersonically milling methods; dispersing methods in which two or more liquids, to which a high pressure is applied, are impacted against each other; and the like methods (these methods are referred to as liquid dispersion methods). In addition, solid dispersion methods in which the materials are mixed using a known mixer such as Banburry's mixers, roll mills, and two-axis extruders to form pellets of the mixture can also be used. The pellets can be molded at a temperature in a wide temperature range. Suitable molding machines include know molding machines. The pellets of the mixture can also be used for the liquid dispersion methods mentioned above.

Specific examples of the core/shell graft copolymers, which are commercially available, are as follows:

Kaneace B series manufactured by Kanegafuchi Chemical Ind. Co., Ltd.; Metablen C, S and W series manufactured by Mitsubishi Rayon Co., Ltd.; Paraloid EXL, HIA, BTA and KCA series manufactured by Kureha Chemical Industry Co., Ltd.; Hiblene B621 manufactured by Nippon Zeon Co., Ltd.; Stafloid series manufactured by Takeda Chemical Industries, Ltd.; BLENDEX 980 manufactured by General Electric Company; KM334 and KM330 manufactured by Rohm and Haas; DURASTRENGTH 200 and META-BLEND S-2001 manufactured by Société National Elf Aquitaine; and FM10 and FM20 manufactured by Kaneka Texas Corp.

The core/shell graft copolymer for use in the present invention is not limited thereto.

Among these core/shell graft copolymers, graft copolymers of Metablen S series manufactured by Mitsubishi Rayon Co., Ltd. are preferable because of having a core constituted of a rubber-like polymer.

In addition, a graft copolymer which is disclosed in JOP No. 10-182841 and in which a colloidal silica serving as a core is covered by a shell of a polyorganosiloxane or the core/shell material is further graft-copolymerized with a vinyl monomer; and a graft copolymer which is disclosed in JOP No. 5-209027 and in which after the surface of a colloidal silica which has been dispersed in a dispersion medium such as organic solvents and water is treated with an alkoxysilane, the dispersion medium is substituted with a radical polymerizable vinyl compound and then the mixture is polymerized.

Next the photoreceptor of the present invention including the above-mentioned core/shell graft copolymer will be explained in detail.

FIGS. 1–7 are cross sections of embodiments of the photoreceptor of the present invention. In FIGS. 1–7, the core/shell graft copolymer is included in the photosensitive layers 2, 21, 22, 23, 24, 25, and 26. As shown in FIGS. 1–7, the core/shell graft copolymer can be used in various layers of the different type photoreceptors.

The photoreceptor as shown in FIG. 1 includes an electroconductive substrate 1, and a photosensitive layer 2 in which a charge generation material 5 and a core/shell graft copolymer 3 are dispersed in a charge transport material 4 which includes a resin having a charge transport ability or a mixture of a low molecular weight charge transport compound and a binder resin. In this case, the resin having a charge transport ability may be used alone or in combination with a binder resin. In addition, the charge transport resin may include a low molecular weight charge transport compound. The charge generation material 5, which includes an inorganic or organic charge generation material, generates a charge carrier. The charge transport resin and/or the binder resin serve as a matrix resin.

The charge transport material 4 receives the charge carrier generated by the charge generation material 5, and transports the charge carrier. In this photoreceptor, it is preferable that the charge generation material 5 and charge transport material 4 absorb light having different wavelength ranges in the visible wavelength region. This is because that the charge transport material 4 has to transmit the light incident upon the surface of the photoreceptor to the charge generation material 4.

Figure 2:
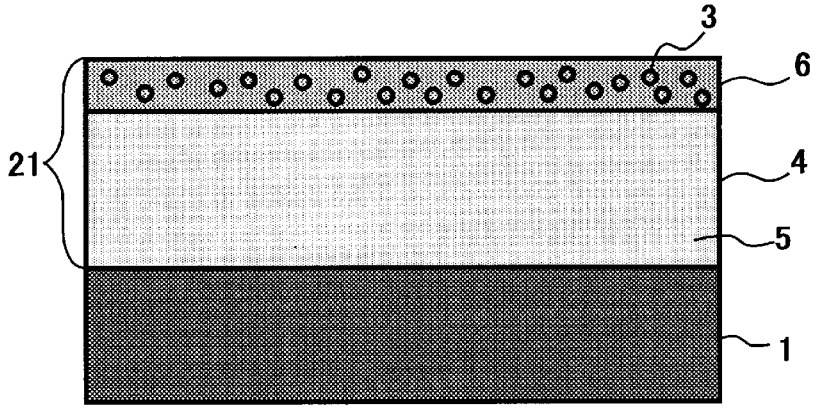

The photoreceptor as shown in FIG. 2 includes a photosensitive layer 21 which includes a charge transport layer 4 formed on an electroconductive substrate 1 and a protective layer 6 formed on the charge transport layer 4. In this case, the protective layer 6 includes a core/shell graft copolymer 3, and a charge transport resin and/or a binder.

The protective layer 6 may be constituted of a low molecular weight charge transport material, a binder resin and a core/shell graft copolymer. In addition, the protective layer 6 may be constituted of a binder resin and a core/shell graft polymer.

Figure 3:
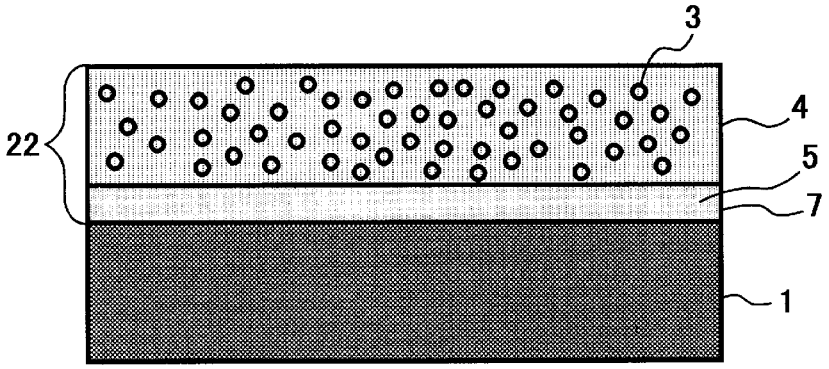

The photoreceptor as shown in FIG. 3 includes a photosensitive layer 22 which includes a charge generation layer 7 formed on an electroconductive layer 1 and mainly including a charge generation material 5, and a charge transport layer 4 formed on the charge generation layer 7 and including a charge transport resin and a core/shell graft polymer 3. In this photoreceptor, light passing through the charge transport layer 4 reaches the charge generation layer 7, resulting in formation of a charge carrier in the lighted area. Then the charge transport layer 4 receives the charge carrier and transports the carrier. Thus the charge generation material 5 in the charge generation layer 7 generates a charge carrier which is used for decaying the charge formed on the photosensitive layer 22, and the charge transport layer 4 transports the carrier to the surface of the photosensitive layer 22 to decay the surface charge. This mechanism is the same as that mentioned in the photoreceptor as shown in FIG. 1.

The charge transport layer 4 includes a charge transport resin optionally together with a binder. In addition, in order to enhance the charge generation efficiency, the charge generation layer 7 may include a charge transport resin or a low molecular weight charge transport material.

The photosensitive layer 22 may include a low molecular weight charge transport material for the same purpose. In addition, the charge transport layer 4 may be constituted of a low molecular weight charge transport material and a binder. Such constitution can be applied to the photosensitive layers 23-26 mentioned later.

Figure 4:
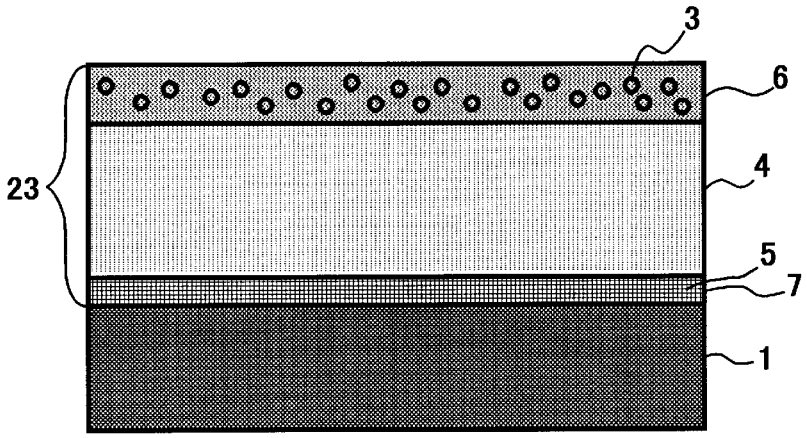

The photoreceptor as shown in FIG. 4 includes a photosensitive layer 23 which includes a charge generation layer 7 including a charge generation material 5 and formed on an electroconductive substrate 1, a charge transport layer 4, and a protective layer 6 formed on the charge transport layer 4 and including a core/shell graft copolymer 3.

Figure 5:
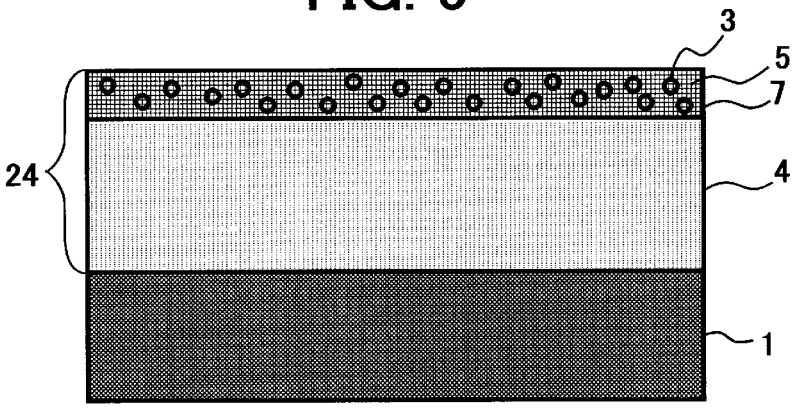

The photoreceptor as shown in FIG. 5 includes a photosensitive layer 24 which includes a photosensitive layer 24 including a charge transport layer 4 formed on an electroconductive substrate 1 and a charge generation layer 7 formed on the charge transport layer 4 and including a charge generation material 5 and a core/shell graft copolymer 3.

Figure 6:
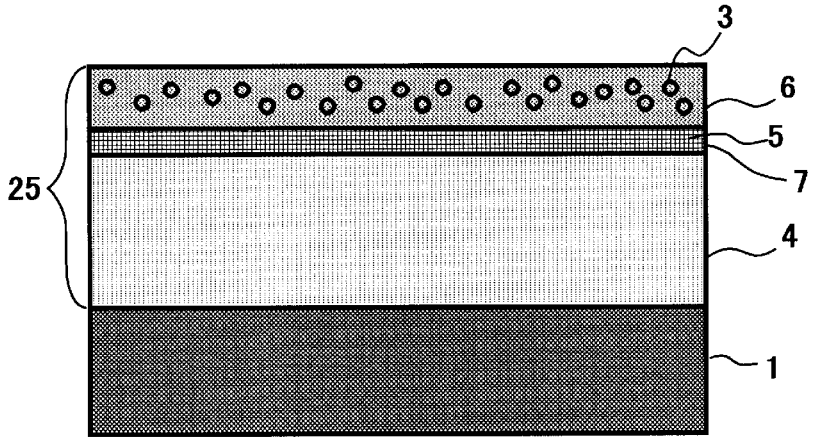

The photoreceptor as shown in FIG. 6 includes a photosensitive layer 25 which includes a charge transport layer 4 formed on an electroconductive substrate 1, a charge generation layer 7 formed on the charge transport layer 4 and including a charge generation material 5, and a protective layer 6 formed on the charge generation layer 7 and including a core/shell graft copolymer 3. The charge generation layer 7 may include a core/shell graft polymer.

Figure 7:
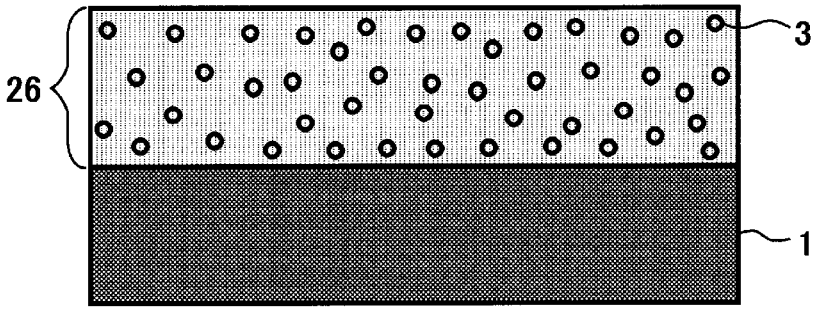

The photoreceptor as shown in FIG. 7 includes a photosensitive layer 26 formed on an electroconductive substrate 1 and including a core/shell graft copolymer 3, a dye serving as a sensitizer (hereinafter "a dye sensitizer") and a charge transport resin optionally together with a binder. As mentioned above, in the photosensitive layer 26 the charge transport resin (and binder resin) may be substituted by a combination of a low molecular weight charge transport material and a binder. In this photoreceptor 26, the charge transport resin or the low molecular weight charge transport material serves as a photoconductive material, and generates a charge carrier and transports the carrier. However, the charge transport resin or low molecular weight charge transport material hardly absorbs light in the visible region. Therefore, in order to form an electrostatic latent image on the photoreceptor using visible light, the dye sensitizer is added therein. Thus, the photosensitive layer 26 can absorb light in the visible region.

Next the method for preparing the photoreceptor of the present invention will be explained.

The photoreceptor as shown in FIG. 1 is typically prepared by the following method:

(1) one or more charge transport resins are dissolved in a solvent optionally together with a binder (or one or more low molecular weight charge transport materials and a binder resin are dissolved in a solvent);

(2) a core/shell graft copolymer 3 and a charge generation material 5 are dispersed in the resin solution prepared above to prepare a coating liquid;

(3) the coating liquid is coated on an electroconductive substrate 1 and the coated liquid is dried to form a photosensitive layer 2.

The thickness of the photosensitive layer 2 is from 3 to 50 $\mu$m, and preferably from 5 to 40 $\mu$m. The total content of the charge transport resin and/or binder in the photosensitive layer 2 is from 30 to 95% by weight. The content of the core/shell graft copolymer in the photosensitive layer 2 is not greater than 20% by weight, and preferably not greater than 10% by weight. As mentioned above, the charge transport resin may be substituted with a combination of a low molecular weight charge transport material and a binder.

The content of the charge generation material 5 in the photosensitive layer 2 is from 0.1 to 50% by weight, and preferably from 1 to 20% by weight.

Specific examples of the charge generation material 5 include inorganic materials such as selenium, selenium-tellurium alloys, cadmium sulfide, cadmium sulfide-selenium, and amorphous silicon; and organic materials such as azo dyes, e.g., C.I. (color index) Pigment Blue 25 (CI21180), C.I. Pigment Red 41 (CI21200), C.I. Acid Red 52 (CI45100) , C.I. Basic Red (CI45210), azo pigments having a carbazole skeleton (disclosed in JOP No.

53-95033), azo pigments having a distyryl benzene skeleton (disclosed in JOP No. 53-133445), azo pigments having a triphenyl amine skeleton (disclosed in JOP No. 53-132347), azo pigments having a dibenzothiophene skeleton (disclosed in JOP No. 54-21728), azo pigments having an oxadiazole skeleton (disclosed in JOP No. 54-12742), azo pigments having a fluorenone skeleton (disclosed in JOP No. 54-22834), azo pigments having a bisstilbene skeleton (disclosed in JOP No. 54-17733), azo pigments having a distyryloxadiazole skeleton (disclosed in JOP No. 54-2129), and azo pigments having a distyrylcarbazole skeleton (disclosed in JOP No. 54-14967); indigo dyes, e.g., C.I. Vat Brown 5 (CI73410) and C.I. Vat Dye (CI73030); and perylene dyes, e.g., Algo Scarlet B and Indanthrene Scarlet R, both manufactured by Bayer AG.

In addition, phthalocyanine pigments having the following formula (N) are also useful as the charge generation material. In formula (N), M represents an element of a metal or a non-metal (hydrogen).

(N)

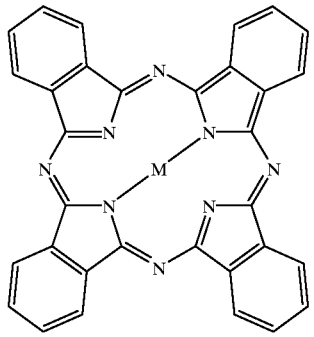

wherein M represents an element selected from H, Li, Be, Na, Ma, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Pt, Au, Hg, TI, La, Ce, Pr, Nd, Pm, Sm, Eu, Gd, Tb, Dy, Ho, Er, Tm, Yb, Lu, Th, Pa, U, Np, Am or the like, or two or more elements such as their oxide, chloride, fluoride, hydroxide, bromide and the like. However, M is not limited thereto.

Such charge generation materials having a phthalocyanine skeleton for use in the present invention at least has a skeleton represented by formula (N), and their polymers, such as dimers, trimers, and polymers having three or more of the structure, may also be used as the charge generation material. Further these materials may have one or more substituents.

Among these phthalocyanine pigments, oxotitanium phthalocyanine pigments having TiO as the center metal M and metal-free phthalocyanine pigments having H (hydrogen) as the center metal M are preferable because of having good electrophotographic properties.

These phthalocyanine pigments have various crystal forms. For example, it is known that oxotitanium phthalocyanine pigments have a crystal form such as α-form, β-form, γ-form, m-form and y-form. Copper phthalocyanine pigments have a crystal form such as α-form, β-form and γ-form. The electrophotographic properties of phthalocyanine pigments changes depending on their crystal form. This is described in detail in Electrophotography, vol. 29, No. 4 (1990). In oxotitanium phthalocyanine pigments, y-form oxotitanium phthalocyanine pigment is preferable for the electrophotographic photoreceptor.

These charge generation materials can be used alone or in combination.

The photoreceptor as shown in FIG. 2 is typically prepared by the following method:

(1) one or more charge transport resins are dissolved in a solvent optionally together with a binder (or one or more low molecular weight charge transport materials and a binder resin are dissolved in a solvent);

(2) a charge generation material 5 is dispersed in the resin solution prepared above to prepare a charge transport layer coating liquid;

(3) the coating liquid is coated on an electroconductive substrate 1 and dried to form a charge transport layer 4;

(4) a charge transport resin and a core/shell graft copolymer 5 are dissolved and dispersed in a solvent to prepare a protective layer coating liquid; and (5) the protective layer coating liquid is coated on the charge transport layer 4 to form a protective layer 6.

The thickness of the protective layer 6 is from 0.15 to 10 μm. The content of the charge transport resin in the protective layer 6 is from 40 to 95% by weight, and the content of the core/shell graft copolymer therein is not greater than 20% by weight, and preferably not greater than 10% by weight. As mentioned above, the charge transport resin may be used together with a binder. In addition, the charge transport resin may be substituted with a combination of a low molecular weight charge transport material and a binder.

The photoreceptor as shown in FIG. 3 is typically prepared by the following method:

(1) a charge generation layer is formed on an electroconductive substrate 1 by depositing a charge generation material thereon using a vacuum evaporation method, or by coating thereon a coating liquid in which a charge generation material 5 and optionally a binder resin are dispersed and dissolved in a solvent, and then drying the coating liquid;

(2) if desired the formed layer is subjected to a surface treatment or a thickness adjusting treatment by buffing and the like, to form a charge generation layer 7; and (3) a charge transport layer 4 is formed thereon by coating a coating liquid in which one or more charge transport resins and a core/shell graft copolymer 5 optionally together with a binder are dissolved or dispersed in a solvent and drying the coated liquid.

As the charge generation material for use in the charge generation layer 7, the materials mentioned above for use in the photosensitive layer 2 can also be used. The thickness of the charge generation layer 7 is not greater than 5 μm, and preferably not greater than 2 μm. The thickness of the charge transport layer 4 is from 3 to 50 μm, and preferably from 5 to 40 μm.

When the charge generation layer 7 is a layer in which a particulate charge generation material 5 is dispersed in a binder, the content of the particulate charge generation material in the charge generation layer 7 is from 10 to 100% by weight, and preferably from 50 to 100% by weight.

The content of the charge transport resin in the charge transport layer 4 is from 40 to 95% by weight, and the content of the core/shell graft copolymer therein is not greater than 20% by weight, and preferably not greater than 10% by weight. As mentioned above, the charge transport resin may be used together with a binder. In addition, the charge transport resin may be substituted with a combination of a low molecular weight charge transport material and a binder.

Specific examples of the low molecular weight charge transport material for use in the charge transport layer 4 include:

oxazole derivatives, and oxadiazole derivatives (both disclosed in JOP Nos. 52-139065 and 52-139066); imidazole derivatives and triphenyl amine derivatives (both disclosed in JOP No. 3-285960); benzidine derivatives (disclosed in JPP No. 58-32372); α-phenylstilbene derivatives (disclosed in JOP No. 57-73075); hydrazone derivatives (disclosed in JOPs Nos. 55-154955, 55-156954, 55-52063 and 56-81850); triphenyl methane derivatives (disclosed in JPP No.51-10983); anthracene derivatives (disclosed in JOP No.51-94829); styryl derivatives (disclosed in JOPs Nos. 56-29245 and 58-198043); carbazole derivatives (disclosed in JOP No. 58-58552); and pyrene derivatives (disclosed in JOP No. 2-94812) The photoreceptor as shown in FIG. 4 is typically prepared by the following method:

(1) a charge generation layer is formed on an electroconductive substrate 1 by depositing a charge generation material thereon using a vacuum evaporation method, or by coating thereon a coating liquid in which a charge generation material 5 and optionally a binder resin are dispersed and dissolved in a solvent, and then drying the coating liquid;

(2) if desired the formed layer is subjected to a surface treatment or a thickness adjusting treatment by buffing and the like, to form a charge generation layer 7;

(3) a charge transport layer 4 is formed thereon by coating a coating liquid in which one or more charge transport resins and a core/shell graft copolymer 5 optionally together with a binder are dissolved or dispersed in a solvent and drying the coated liquid; and (4) a protective layer 6 is formed on the charge transport layer 4 in a method similar to the method mentioned above for use in the photoreceptor as shown in FIG. 2.

The charge transport resin may be substituted with a combination of a low molecular weight charge transport material and a binder.

The photoreceptor as shown in FIG. 5 is typically prepared by the following method:

(1) a charge transport layer 4 is formed on an electroconductive substrate by coating a coating liquid in which one or more charge transport resins are dissolved in a solvent optionally together with a binder (or a low molecular weight charge transport material and a binder are dissolved in a solvent) and drying the coated liquid; and (2) a charge generation layer 7 is formed thereon, for example, by spray-coating a coating liquid in which a particulate charge generation material and a core/shell graft copolymer are dispersed in a solvent optionally including a binder and then drying the coated liquid.

The preferable content of each material in the charge generation layer 7 and charge transport layer 4 is the same as that mentioned above in the photoreceptor as shown in FIG. 4.

The photoreceptor as shown in FIG. 6 is typically prepared by the following method:

(1) a charge transport layer 4 is formed on an electroconductive substrate by coating a coating liquid in which one or more charge transport resins are dissolved in a solvent optionally together with a binder (or a low molecular weight charge transport material and a binder are dissolved in a solvent) and drying the coated liquid;

(2) a charge generation layer 7 is formed thereon, for example, by spray-coating a coating liquid in which a particulate charge generation material is dispersed in a solvent optionally including a binder and then drying the coated liquid; and (3) a protective layer 6 is formed thereon by the method mentioned above for use in the photoreceptor as shown in FIG. 2.

The photoreceptor as shown in FIG. 7 is typically prepared by the following method:

(1) a core/shell graft copolymer, and one or more charge transport resins are dissolved or dispersed in a solvent optionally together with a binder;

(2) a dye sensitizer is added thereto to prepare a photosensitive layer coating liquid; and (3) the coating liquid is coated on an electroconductive substrate 1 to form a photosensitive layer 26.

As mentioned above, the charge transport resin may be substituted with a combination of a low molecular weight charge transport material and a binder.

The thickness of the photosensitive layer 26 is from 3 to 50 μm, and preferably from 5 to 40 μm. The content of the charge transport resin (or the low molecular weight charge transport material) in the photosensitive layer 26 is from 30 to 100% by weight. The content of the dye sensitizer therein is from 0.1 to 5% by weight, and preferably from 0.5 to 3% by weight.

Specific examples of the dye sensitizer include triaryl methane dyes such as Brilliant Green, Victoria Blue B, methyl violet, crystal violet, and Acid Violet 6B; xanthene dyes such as Rhodamine B, Rhodamine 6G, Rhodamine G Extra, Eosin S, Erythrosine, Rose Bengale, and fluorescein; thiazine dyes methylene blue; and cyanine dyes such as cyanine.

Suitable electroconductive substrates for use in the photoreceptor of the present invention include cylinders, plates and foils of a metal such as aluminum; plastic films on which a layer of a metal such as aluminum is formed by a vacuum evaporation method or the like; and papers which are subjected to an electroconductive treatment.

Suitable binders for use in the photoreceptor include condensation resins such as polyamide resins, polyurethane resins, polyester resins, epoxy resins, polyketone resins, and polycarbonate resins; vinyl polymers such as polyvinyl ketone resins, polystyrene resins, poly-N-vinyl carbazole resins, and polyacryl amide resins. The binder resin is not limited thereto, and any resins having a combination of a good insulation property and adhesion property can be used as the binder.

In addition, additives such as plasticizers (e.g., halogenated paraffin, dimethyl naphthalene and dibutyl phthalate), antioxidants, photo-stabilizers, heat-stabilizers, lubricants and the like can be used together with the binder.

The photoreceptor of the present invention may have an adhesive layer or a barrier layer between the substrate 1 and the photosensitive layer. Suitable materials for use in such a layer include polyamide resins, nitrocellulose resins, aluminum oxide, titanium oxide and the like materials. The thickness of the layer is preferably not greater than 1 μm.

The thus prepared photoreceptor of the present invention has good photosensitivity, and excellent abrasion resistance. The reason for the excellent abrasion resistance is considered as follows:

(1) the core layer has high abrasion resistance and/or high elastic property; and (2) the shell layer has good compatibility with the matrix resin used in the image forming layer.

The contact angle of the surface of the photoreceptor of the present invention against water is preferably not less than 90°, and more preferably from 95° to 140°. When such a core/shell graft copolymer mentioned above is included in the surface layer of the photoreceptor, the surface layer has a water-repellent property, and achieves such a high contact angle against water.

When the contact angle of the surface of the photoreceptor is too low, byproducts caused by charging and dust of the toner and transfer paper used tend to adhere to the surface, resulting in decrease of the surface resistivity of the photoreceptor and thereby undesired images such as tailing tend to be produced. On the contrary, when the contact angle thereof is too large, the adhesion of toner to the surface is not good, resulting in deterioration of image qualities.

In the present invention, the contact angle of the photoreceptor against pure water is measured by a liquid drop method using a contact angle measuring instrument CA-W manufactured by KYOWA INTERFACE SCIENCE CO., LTD.

The coefficient of static friction of the surface of the photoreceptive layer measured by a Bowden method is preferably from 0.05 to 0.4 to improve the cleaning property and abrasion resistance thereof. In particular, when the static friction coefficient is from 0.1 to 0.3, the abrasion resistance can be remarkably improved. When the static friction coefficient is too small, the adhesion of toner decreases, and therefore the electrostatic latent images formed on the photoreceptor cannot be faithfully developed, result in deterioration of image qualities of the resultant toner images.

Next, the electrophotographic image forming method and apparatus of the present invention will be explained in detail referring to drawings.

Figure 13:
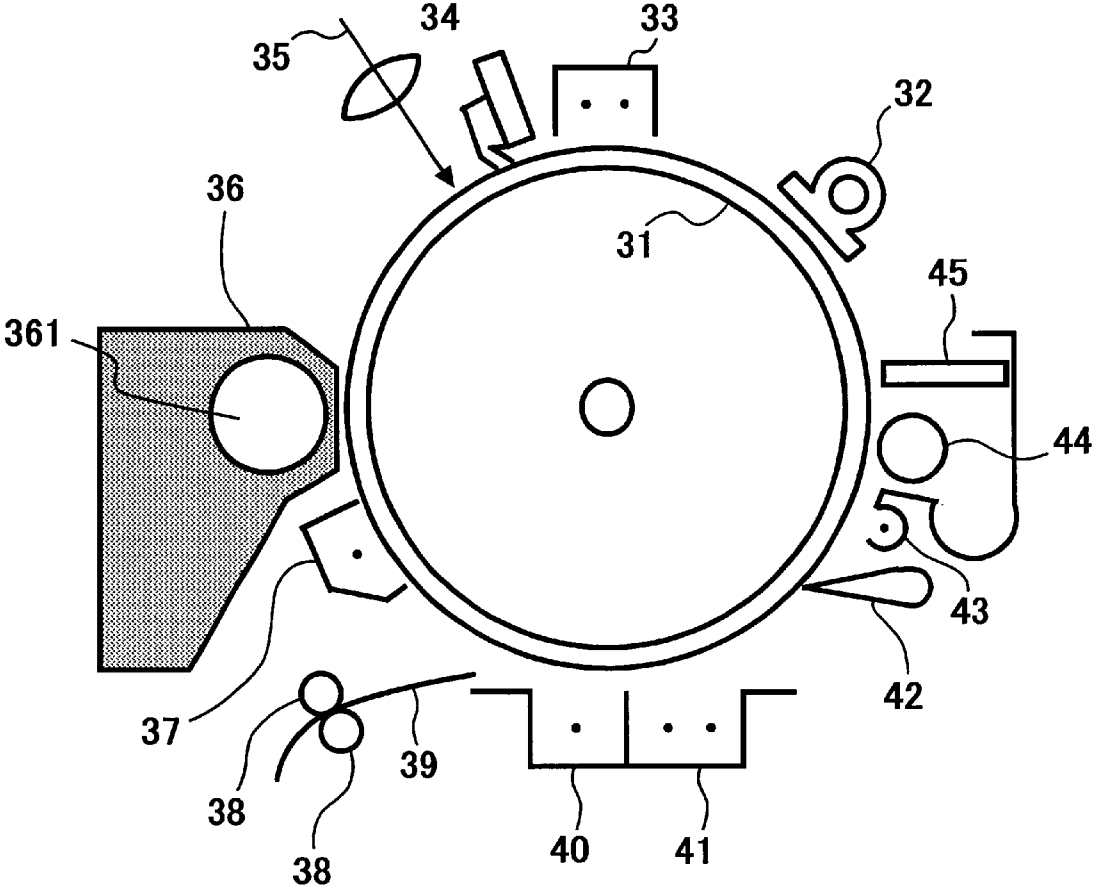
FIG. 13 is a schematic view illustrating the main part of an embodiment of the electrophotographic image forming apparatus of the present invention.

FIG. 13 is a schematic view illustrating a main part of an embodiment of the electrophotographic image forming apparatus of the present invention. In FIG. 13, numeral 31 denotes the photoreceptor of the present invention. The photoreceptor has a drum shape in FIG. 13, however, photoreceptors having a sheet shape, an endless belt shape or the like can also be used.

Around the photoreceptor 31, a discharging lamp 32, a charger 33, an eraser 34, an imagewise light irradiating device 35, a developing unit 36, a pre-transfer charger 37, a transfer charger 40, a separating charger 41, a separating pick 42, a pre-cleaning charger 43, a cleaning brush 44, and a cleaning blade 45 are counterclockwise configured in this order. In addition, a pair of registration rollers 38 are provided to feed a transfer paper 39 to the space between the photoreceptor 31 and the transfer charger 40 (and the separating charger 41). The photoreceptor 31 rotates in a counterclockwise direction.

The photoreceptor 31 is positively or negatively charged with the charger 33 while the photoreceptor 31 is rotating. Residual toner is removed from the photoreceptor 31 by the eraser 34, and then the imagewise light irradiating device 35 irradiates the photoreceptor 31 with light to form an electrostatic latent image on the photoreceptor 31.

Suitable charging devices for use as the charger 33, pre-transfer charger 37, transfer charger 40, separating charger 41, and pre-cleaning charger 43 include known charging devices such as corotrons, scorotrons, solid state chargers, charging rollers and the like.

Any known charging devices can be used as the transfer charger 40; however, the transfer device as shown in FIG. 13, i.e., a combination of the transfer charger 40 and the separating charger 41, is preferable because of being efficient.

Suitable light sources for use in the light irradiating device 35 and the discharging lamp 32 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used. These light sources can also be used for the image transfer process, discharging process, and cleaning process, and a pre-exposure process which is optionally performed, if it is needed to irradiate the photoreceptor 31 with light in the processes.

The electrostatic latent image formed on the photoreceptor 31 is then developed with a toner on a developing roller 361 in the developing unit 36. The toner image formed on the photoreceptor 31 is then charged with the pre-transfer charger 37 so that the toner image has a charge suitable for transferring. The toner image is then transferred onto the transfer paper 39 while the transfer paper 39 is charged with the transfer charger 40. The transfer paper 39 is then charged with the separating charger 41 so as to easily separate from the photoreceptor 31 by being released from the state in which the transfer paper 39 and the photoreceptor 31 are electrostatically adhered to each other. The transfer paper 39 is then separated from the photoreceptor 31 with the separating pick 42. After the toner image transferring process, the surface of the photoreceptor 31 is cleaned using the pre-cleaning charger 43, the fur brush 44 and the cleaning blade 45. The residual toner remaining on the photoreceptor 31 can be removed by only a cleaning brush. Suitable cleaning brushes include known brushes such as fur brushes and magnet fur brushes When the photoreceptor 31 which is previously charged positively or negatively is exposed to imagewise light, an electrostatic latent image having a positive or negative charge is formed on the photoreceptor 31. When the latent image having a positive (negative) charge is developed with a toner having a negative (positive) charge, a positive image (i.e., the same image as the latent image) can be obtained. In contrast, when the latent image having a positive (negative) charge is developed with a toner having a positive (negative) charge, a negative image (i.e., a reversal image) can be obtained. As the developing method, known developing methods can be used. In addition, as the discharging methods, known discharging methods can also be used.

Figure 14:
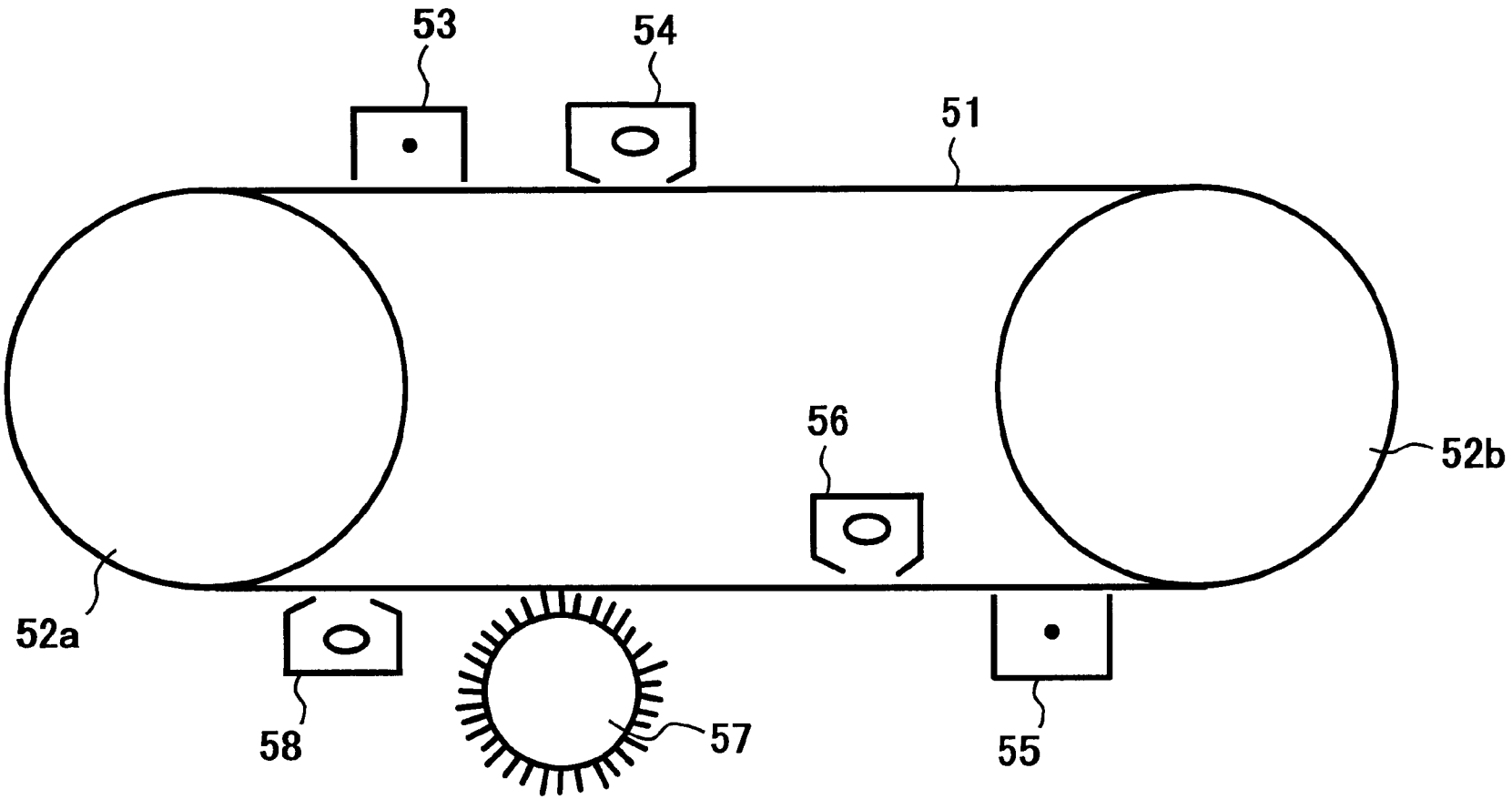
FIG. 14 is a schematic view illustrating the main part of another embodiment of the electrophotographic image forming apparatus of the present invention.

FIG. 14 is a schematic view for illustrating a main part of another embodiment of the image forming apparatus of the present invention. In this embodiment, an endless belt-shaped photoreceptor 51 is used. The photoreceptor 51 is the photoreceptor of the present invention.

The belt-shaped photoreceptor 51 is rotated in the clockwise direction by rollers 52*a* and 52*b*. The photoreceptor 51 is charged with a charger 53, and then exposed to imagewise light emitted by a light irradiating device 54 to form an electrostatic latent image in the photoreceptor 51. The latent image is developed with a developing unit (not shown in FIG. 14) to form a toner image on the photoreceptor 51. The toner image is transferred onto a transfer paper (not shown) using a transfer charger 55. After the toner image transferring process, the surface of the photoreceptor 51 is cleaned with a cleaning brush 57 after performing a pre-cleaning light irradiating operation using a pre-cleaning light irradiating device 56. Then the photoreceptor 51 is discharged by being exposed to light emitted by a discharging light source 58. In the pre-cleaning light irradiating process, light may irradiate the photoreceptor 51 from the side of the substrate thereof. In this case, the substrate has to be light-transmissive.

The image forming apparatus of the present invention is not limited to the image forming units as shown in FIGS. 13 and 14. For example, in FIG. 14, thepre-cleaning light irradiating operation can be performed from the photosensitive layer side of the photoreceptor 51. In addition, the light irradiation in the light image irradiating process and the discharging process may be performed from the substrate side of the photoreceptor 51. In this case, the substrate has to be transmissive.

Further, a pre-transfer light irradiation operation, which is performed before the transferring of the toner image, and a preliminary light irradiation operation, which is performed before the imagewise light irradiation, and other light irradiation operations may also be performed.

The above-mentioned image forming unit may be fixedly set in a copier, a facsimile or a printer. However, an image forming unit may be set therein as a process cartridge. The process cartridge means an image forming unit which includes at least a photoreceptor and at least one of a charging device, a light irradiation device, a developing device, a transfer device, a cleaning device, and a discharge device.

Figure 15:
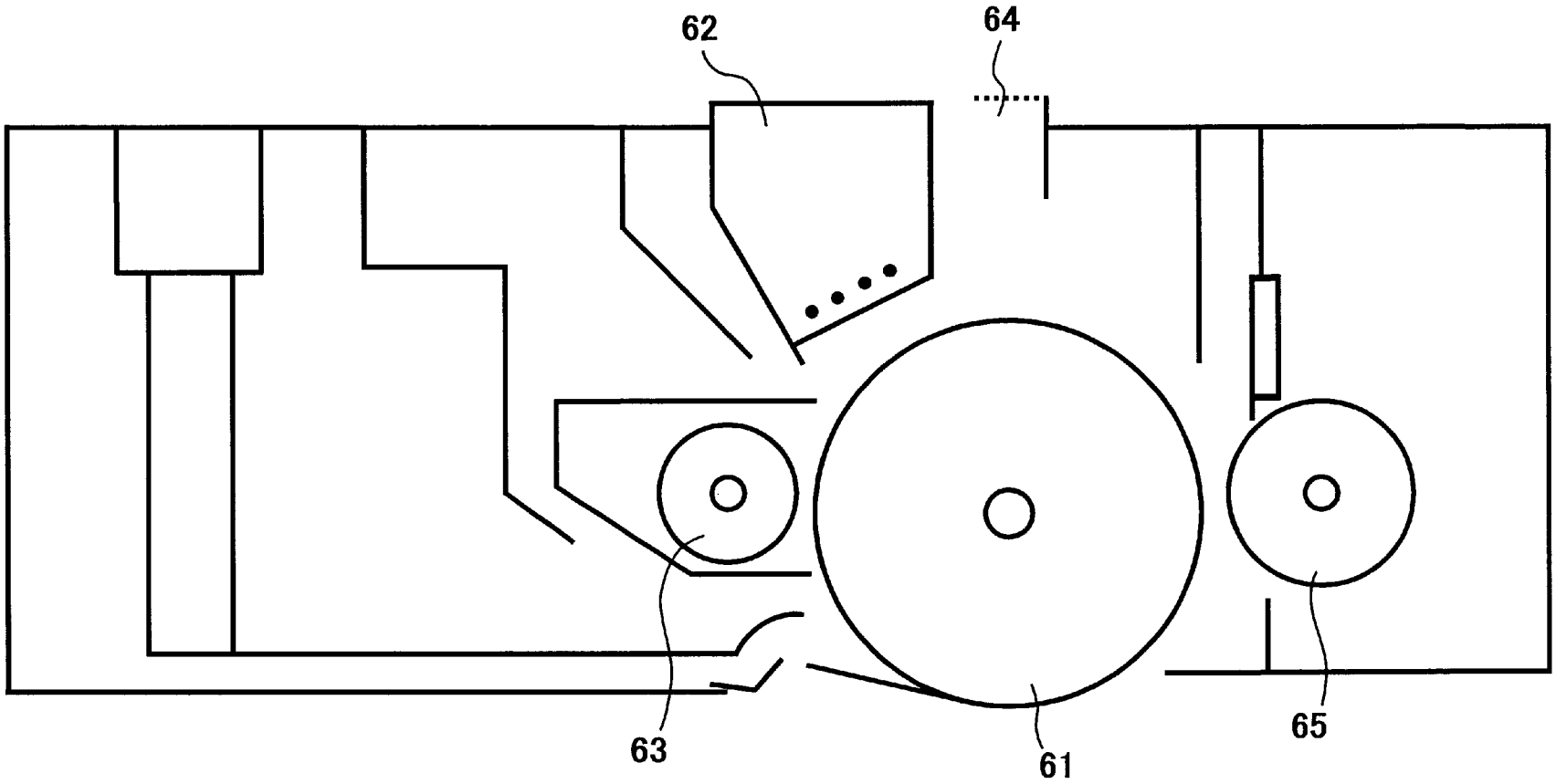
FIG. 15 is a schematic view illustrating an embodiment of the process cartridge of the present invention.

FIG. 15 is a schematic view illustrating an embodiment of the process cartridge of the present invention. In FIG. 15, the process cartridge includes a photoreceptor 61, a charger 62, a cleaning brush 63, a light irradiation device 64 and a developing roller 65. The photoreceptor 61 is the photoreceptor of the present invention. The process cartridge of the present invention is not limited thereto, and includes at least the photoreceptor of the present invention and at least one of the devices mentioned above.

The core/shell graft copolymer of the present invention can be used for the following image bearing members as well as the photoreceptor:

(1) electrostatic latent image bearing members

Figure 8:
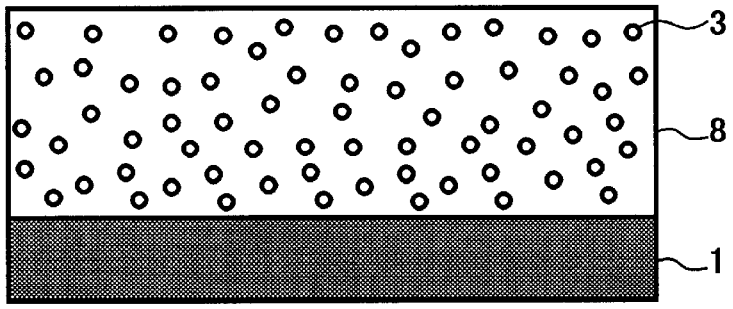
FIGS. 8 and 9 are schematic views illustrating the cross sections of embodiments of the image bearing member of the present invention.
Figure 9:
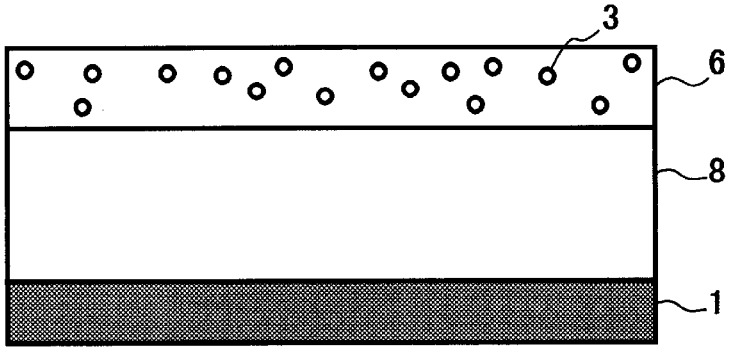

The core/shell graft copolymers can be used as the electrostatic latent image bearing members as shown in FIGS. 8 and 9. In FIG. 8, a dielectric layer 8 including a core/shell graft copolymer 3 is formed on an electroconductive substrate 1. In FIG. 9, a dielectric layer 8 is formed on an electroconductive substrate 1, and a protective layer 6 including a core/shell graft copolymer 3 is formed thereon.

Figure 10:
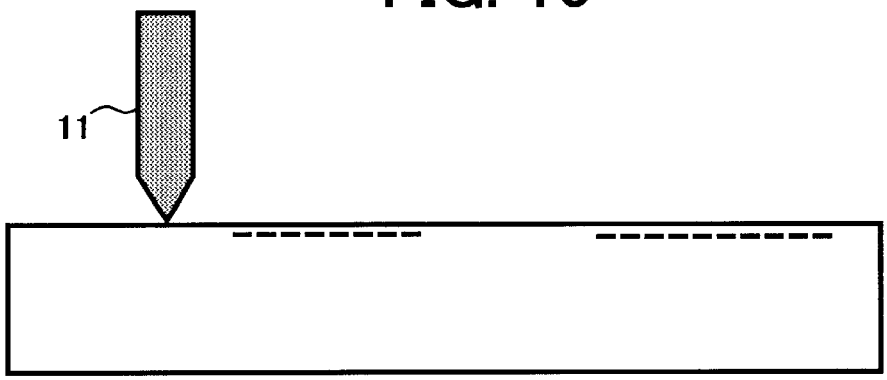
FIG. 10 is a schematic view for explaining how an electrostatic latent image is formed on the image bearing member of the present invention.

As shown in FIG. 10, a charging head 11 applies a voltage to the surface of the image bearing member as shown in FIG. 8 or 9 according to image information to form an electrostatic latent image thereon. The latent image is then developed with one or more toners to form a toner image thereon. The toner image is then transferred onto a receiving material such as transfer paper, and the toner image is fixed. Thus images are formed.

The charging head is not limited to the charging head 11, and multiple charging heads, in which multiple small charging heads are arrayed at a regular interval, and the like can also be used.

Electrostatic latent images may be formed by transferring electrostatic latent images formed on a photoreceptor onto the image bearing member of the present invention.

Such image bearing members are abraded when repeatedly used, resulting in shortage of the life. This problem is similar to the abrasion problem of the photoreceptor. In addition, when repeatedly used, constituents of the toner used, such as resins, charge controlling agents and the like, and dust of transfer paper adhere to the image bearing members, resulting in formation of undesired images. Such problems can be solved by using a core/shell graft copolymer in the surface portion of an image bearing member because the friction coefficient of the surface can be decreased and the releasability of the surface can be improved.

(2) intermediate transfer medium

There are known electrophotographic image forming processes in which toner images formed on one or more photoreceptors are transferred on an intermediate transfer medium one by one, and then the transferred toner images are then re-transferred onto a receiving material such as transfer paper. These processes are often used to form a color image.

As the intermediate transfer medium, media in which a transfer layer having a medium electric resistivity of from $10^8$ to $10^{12}$ Ω·cm; media in which a surface layer having a high resistivity is formed on the above-mentioned transfer layer; media in which a layer whose resistivity changes depending on the transfer electric field is formed as a transfer layer; and the like are known.

In such various intermediate transfer media, the above-mentioned abrasion problem and dust adhesion problem occur. By using a core/shell graft copolymer in the surface portion of the intermediate transfer media, such problems can be solved.

Figure 11:
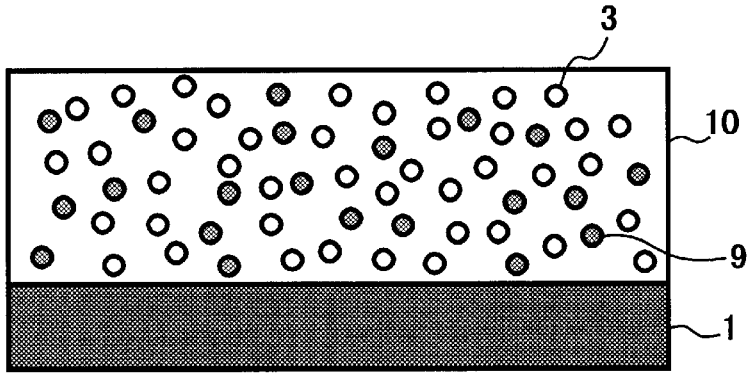
FIGS. 11 and 12 are schematic views illustrating the cross sections of embodiments of the intermediate transfer medium of the present invention.
Figure 12:
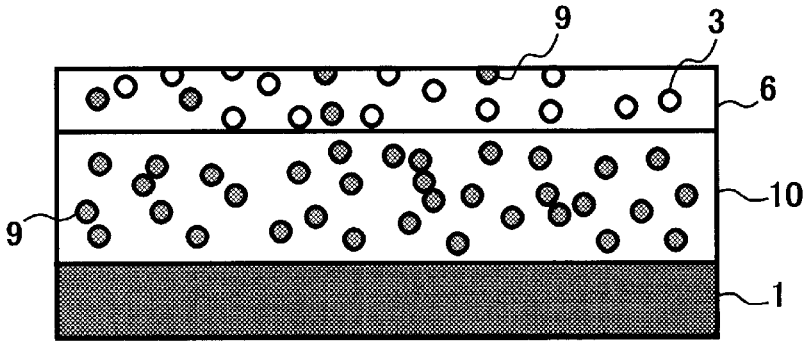

FIGS. 11 and 12 are schematic views illustrating cross sections of embodiments of the intermediate transfer material of the present invention. In FIG. 11, a layer 10 including a core/shell graft copolymer 3 and a resistance controlling agent 9 are formed on an electroconductive substrate 1. In FIG. 12, a transfer layer 10 including a resistance controlling agent 9 is formed on an electroconductive substrate 1. In addition, a layer 6 including a core/shell graft copolymer 3 and the resistance controlling agent 9 is formed thereon. The intermediate transfer medium may include additives other than the resistance controlling agent.

(3) Others

The image bearing material of the present invention can also be used for the following applications:

(A) a coat layer formed on a carrier used for two-component developers.

(B) releasability imparting agents of toners.

(C) a surface layer of charging rollers which are typically used for charging photoreceptors.

Suitable charge transport resins for use in the present invention include known charge transport polymers. For example, the charge transport polymers, which have been disclosed in JOPs Nos. 51-73888, 54-8527, 54-11737, 56-150749, 57-78402, 63-285552, 64-1728, 64-13061, 64-19049, 3-50555, 4-225014, 4-230767, 5-232727 and 5-310904, can be used.

In addition, the following charge transport polymers having a triarylamine structure can also be used in the present invention:

Acetophenone derivatives (JOP 8-269183); distyryl benzene derivatives (JOP 9-71642); diphenethyl benzene derivatives (JOP 9-104746); α-phenyl stilbene derivatives (JOP 9-272735); butadiene derivatives (JOP 9-235367); hydrogenated butadiene derivatives (JOP 9-87376); diphenylcyclohexane derivatives (JOP 9-110976); distyryltriphenylamine derivatives (JOP 9-268226); distyryldiamine derivatives; diphenyl distyrylbenzene derivatives (JOP 9-221544 and 9-227669); stilbene derivatives (JOP 9-157378); m-phenylenediamine derivatives (JOP 9-302084 and 9-302085); resorcin derivatives (JOP 328539); fluorenone derivatives (JOP 11-5836); and phenoxy stilbene derivatives (11-71453).

Further, polycarbonate resins having a triaryl amine structure can also be used as charge transport polymers. Specific examples thereof include known polycarbonate resins disclosed in U.S. Pat. Nos. 4,801,517, 4,806,443, 4,806,444, 4,937,165, 4,959,288, 5,030,532, 5,034,296, and 5,080,989, and JOP 64-9964, 3-221522, 2-304456, 4-11627, 4-175337, 4-18372, 4-31404 and 4-133065.

Among these charge transport polycarbonate resins, resins having the following formula (1) are preferably used in the present invention.

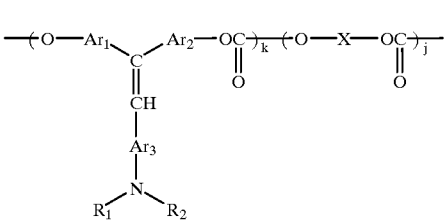

(I)

As described in JOP 9-297419, the polycarbonate resins can be prepared by a solution or interfacial polymerization method using a diol compound, a diphenol compound and a halogenated carbonyl compound such as phosgene.

It is preferable that the polymerization of the polycarbonate resins is controlled by using one or more termination agent. Therefore the end parts of the polycarbonate resins may be connected with the termination agent. Namely the polycarbonate resins may have the residual group of the termination agent at the end parts thereof.

Specific examples of such termination agents include mono-valence aromatic hydroxyl compounds, haloformate derivatives of mono-valence aromatic hydroxyl compounds, mono-valence carboxylic acids and halide derivatives of mono-valence carboxylic acids. Among these compounds, mono-valence aromatic hydroxyl compounds are preferable. Specific examples of such mono-valence aromatic hydroxyl compounds include phenol, p-tert-butylphenol, and p-cumylphenol. The polycarbonate resins preferably have a polystyrene-conversion number average molecular weight of from 1000 to 500000 and more preferably from 10000 to 200000.

The polycarbonate resins having formula (1) will be explained in detail.

In formula (1), R17 and R18 independently represent an acyl group, a substituted or unsubstituted alkyl group, or a substituted or unsubstituted aryl group. Suitable substituted or unsubstituted alkyl groups include linear or branched alkyl groups having from 1 to 5 carbon atoms. The alkyl groups may further include a fluorine atom, a cyano group, a phenyl group a halogen atom or a phenyl group substituted with a linear or branched alkyl group having from 1 to 5 carbon atoms. Specific examples of such alkyl groups include a methyl group, an ethyl group, a n-propyl group, an i-propyl group, a t-butyl group, a s-butyl group, a n-butyl group, an i-butyl group, a trifluoromethyl group, a 2-cyanoethyl group, a benzyl group, a 4-chlorobenzyl group, a 4-methylbenzyl group and the like.

Specific examples of the substituted or unsubstituted aryl groups include a phenyl group, a naphthyl group, a biphenyl group, a terphenylyl group, a pyrenyl group, a fluorenyl group, a 9,9-dimethyl-2-fluorenyl group, an azulenyl group, an anthryl group, a triphenylenyl group, a crycenyl group, a fluorenylidene phenyl group, a 5H-dibenzo [a,d] cycloheptenylidene phenyl group, a thienyl group, a benzothienyl group, a furyl group, a benzofranyl group, a carbazolyl group, a pyridinyl group, a pyrrolidyl group, an oxazolyl group, and the like. These groups may have a substituted or unsubstituted alkyl group, or a substituted or unsubstituted alkoxyl group having a substituted or unsubstituted alkyl group, or a hologen atom such as a fluorine atom, a chlorine atom, a bromine atom or an iodine atom, or an amino group having the following formula:

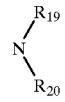

wherein R19 and R20 independently represent one of the substituted or unsubstituted alkyl groups or substituted or unsubstituted aryl groups defined above for use in R17 and R18, wherein R19 and R20 may be combined to form a ring such as a piperidino group, a morphorino group, a julolidyl group or the like.

In formula (1), Ar1, Ar2, and AR3 independently represent a substituted or unsubstituted arylene group.

In formula (1), when X is an aliphatic divalent group or an alicyclic divalent group, specific examples of the diol compound are as follows:

ethylene glycol, diethylene glycol, triethylene glycol, polyethylene glycol, polytetramethylene ether glycol, 1,3-propane diol, 1,4-butane diol, 1,5-pentane diol, 3-methyl-1,5-pentane diol, 1,6-hexane diol, 1,5-hexane diol, 1,7-heptane diol, 1,8-octane diol, 1,9-nonane diol, 1,10-decane diol, 1,11-undecane diol, 1,12-dodecane diol, neopentyl glycol, 2-ethyl-1,6-hexane diol, 2-methyl-1,3-propane diol, 2-ethyl-1,3-propane diol, 2,2-dimethyl-1,3-propane diol, 1,3-cyclohexane diol, 1,4-cyclohexane diol, cyclohexane-1,4-dimethanol, 2,2-bis(4-hydroxycyclohexyl)propane, xylylene diol, 1,4-bis(2-hydroxyethyl)benzene, 1,4-bis(3-hydroxypropyl)benzene, 1,4-bis(4-hydroxybutyl)benzene, 1,4-bis(5-hydroxypentyl)benzene, 1,4-bis(6-hydroxyhexyl) benzene, isophorone diol and the like.

When X is an aromatic divalent group, divalent groups derived from the substituted or unsubstituted aryl groups defined above are used as the arylene group.

In addition, X includes divalent groups having one of the following formulae:

(1-2)

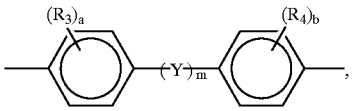

(1-3)

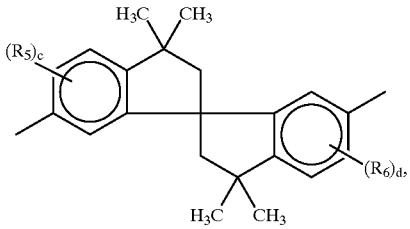

-continued (1-4)

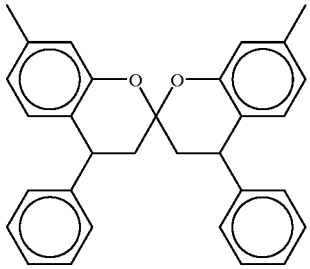

wherein R3, R4, R5 and R6 independently represent a substituted or unsubstituted alkyl group, a substituted or unsubstituted aryl group, or a halogen atom; a and b are independently 0 or an integer of from 1 to 4; c and d are independently 0 or an integer of from 1 to 3, wherein when any of a, b, c and d are greater than 1, the plural R3, R4, R5 or R6 groups may be the same as or different from one another; m is 0 or 1; Y represents a linear alkylene group having from 2 to 12 carbon atoms, a substituted or unsubstituted branched alkylene group having from 3 to 12 carbon atoms, a divalent group constituted of one or more alkylene groups having from 1 to 10 carbon atoms and at least an oxygen atom and a sulfur atom, —O—, —S—, —SO—, —$SO_2$—, —CO—, —COO—, or a group having one of the following formulae:

(1-5)

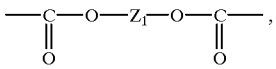

(1-6)

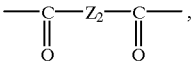

(1-7)

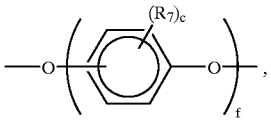

(1-8)

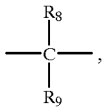

(1-9)

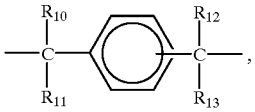

(1-10)

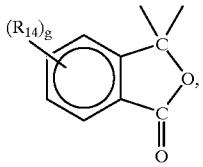

-continued (1-11)

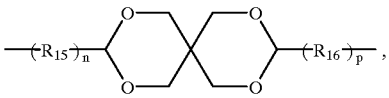

(1-12)

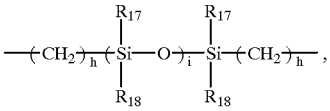

(1-13)

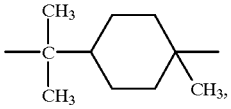

(1-14)

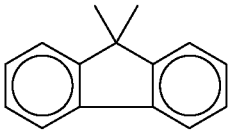

wherein Z1 and Z2 independently represent a substituted or unsubstituted aliphatic divalent group or a substituted or unsubstituted arylene group; R7 and R14 independently represent a halogen atom, a substituted or unsubstituted alkyl group, a substituted or unsubstituted alkoxyl group, or a substituted or unsubstituted aryl group; R8, R9, R10, R11, R12 and R13 independently represent a hydrogen atom, a halogen atom, a substituted or unsubstituted alkyl group, a substituted or unsubstituted alkoxyl group, or a substituted or unsubstituted aryl group, wherein R8 and R9 may be combined to form a ring having from 5 to 12 carbon atoms; R15 and R16 independently represent an alkylene group having from 1 to 4 carbon atoms, wherein n and p are independently 0 or 1; R17 and R18 independently represent a substituted or unsubstituted alkyl group, or a substituted or unsubstituted aryl group; and e and g are independently 0 or an integer of from 1 to 4, f is 1 or 2, h is 0 or an integer of from 1 to 20, and i is 0 or an integer of from 1 to 2000.

Specific examples of the divalent groups constituted of one or more alkylene group having from 1 to 10 carbon atoms and one or more oxygen atoms and/or one or more sulfur atoms include: —$OCH_2CH_2O$—; —$OCH_2CH_2OCH_2CH_2O$—; —$OCH_2CH_2OCH_2CH_2OCH_2CH_2O$—; —$OCH_2CH_2CH_2O$—; —$OCH_2CH_2CH_2CH_2O$—; —$OCH_2CH_2CH_2CH_2CH_2CH_2O$—; —$OCH_2CH_2CH_2CH_2CH_2CH_2CH_2CH_2O$—; —$CH_2O$—; —$CH_2CH_2O$—; —$CHC_2H_5OCHC_2H_5O$—; —$CHCH_3O$—; —$SCH_2OCH_2S$—; —$CH_2OCH_2$—; —$OCH_2OCH_2O$—; —$SCH_2CH_2OCH_2OCH_2CH_2S$—; —$OCH_2CHCH_3OCH_2CHCH_3O$—; —$SCH_2S$—; —$SCH_2CH_2S$—; —$SCH_2CH_2CH_2S$—; —$SCH_2CH_2CH_2CH_2S$—; —$SCH_2CH_2CH_2CH_2CH_2CH_2S$—; —$SCH_2CH_2SCH_2CH_2S$—; and —$SCH_2CH_2OCH_2CH_2OCH_2CH_2S$—.

The substituents of the branched alkylene groups having from 3 to 12 carbon atoms include a substituted or unsubstituted alkyl group, a substituted or unsubstituted aryl group or a halogen atom.

Among these substituents, the substituted or unsubstituted alkyl group and substituted or unsubstituted aryl group are defined above. When Z1 and Z2 are substituted or unsubstituted divalent aliphatic groups, divalent aliphatic groups which are obtained by reducing all hydroxyl groups from the aliphatic or alicyclic diols defined above for use as X. When Z1 and Z2 are substituted or unsubstituted arylene groups, divalent groups which are derived from the substituted or unsubstituted aryl groups defined above.

When X is an aromatic divalent group, specific examples of suitable diols include:

bis(4-hydroxyphenyl)methane, bis(2-methyl-4-hydroxyphenyl)methane, bis(3-methyl-4-hydroxyphenyl)methane, 1,1-bis(4-hydroxyphenyl)ethane, 1,2-bis(4-hydroxyphenyl)ethane, bis(4-hydroxyphenyl)phenylmethane, bis(4-hydroxyphenyl)diphenylmethane, 1,1-bis(4-hydroxyphenyl)-1-phenylethane, 1,3-bis(4-hydroxyphenyl)-1,1-dimethylpropane, 2,2-bis(4-hydroxyphenyl)propane, 2-(4-hydroxyphenyl)-2-(3-hydroxyphenyl)propane, 1,1-bis(4-hydroxyphenyl)-2-methylpropane, 2,2-bis(4-hydroxyphenyl)butane, 1,1-bis(4-hydroxyphenyl)-3-methylbutane, 2,2-bis(4-hydroxyphenyl)pentane, 2,2-bis(4-hydroxyphenyl)-4-methylpentane, 2,2-bis(4-hydroxyphenyl)hexane, 4,4-bis(4-hydroxyphenyl)heptane, 2,2-bis(4-hydroxyphenyl)nonane, bis(3,5-dimethyl-4-hydroxyphenyl)methane, 2,2-bis(3-methyl-4-hydroxyphenyl)propane, 2,2-bis(3-isoproyl-4-hydroxyphenyl)propane, 2,2-bis(3-sec-butyl-4-hydroxyphenyl)propane, 2,2-bis(3-tert-butyl-4-hydroxyphenyl)propane, 2,2-bis(3-cyclohexyl-4-hydroxyphenyl)propane, 2,2-bis(3-allyl-4-hydroxyphenyl)propane, 2,2-bis(3-phenyl-4-hydroxyphenyl)propane, 2,2-bis(3,5-dimethyl-4-hydroxyphenyl)propane, 2,2-bis(3-chloro-4-hydroxyphenyl)propane, 2,2-bis(3,5-dichloro-4-hydroxyphenyl)propane, 2,2-bis(3-bromo-4-hydroxyphenyl)propane, 2,2-bis(3,5-dibromo-4-hydroxyphenyl)propane, 2,2-bis(4-hydroxyphenyl)hexafluoropropane, 1,1-bis(4-hydroxyphenyl)cyclopentane, 1,1-bis(4-hydroxyphenyl)cyclohexane, 1,1-bis(3-methyl-4-hydroxyphenyl)cyclohexane, 1,1-bis(3,5-dimethyl-4-hydroxyphenyl)cyclohexane, 1,1-bis(3,5-dichloro-4-hydroxyphenyl)cyclohexane, 1,1-bis(4-hydroxyphenyl)-3,3,5-trimethylcyclohexane, 1,1-bis(4-hydroxyphenyl)cycloheptane, 2,2-bis(4-hydroxyphenyl)norbornane, 2,2-bis(4-hydroxyphenyl)adamantane, 4,4'-dihydroxydiphenyl ether, 4,4'-dihydroxy-3,3'-dimethyldiphenyl ether, ethyleneglycolbis(4-hydroxyphenyl)ether, 1,3-bis(4-hydroxyphenoxy)benzene, 1,4-bis(3-hydroxyphenoxy)benzene, 4,4'-dihydroxydiphenyl sulfide, 3,3'-dimethyl-4,4'-dihydroxydiphenyl sulfide, 3,3',5,5'-tetramethyl-4,4'-dihydroxydiphenyl sulfide, 4,4'-dihydroxydiphenyl sulfoxide, 3,3'-dimethyl-4,4'-dihydroxydiphenyl sulfoxide, 4,4'-dihydroxydiphenyl sulfone, 3,3'-dimethyl-4,4'-dihydroxydiphenyl sulfone, 3,3'-dipheyl-4,4'-dihydroxydiphenyl sulfone, 3,3'-dichloro-4,4'-dihydroxydiphenyl sulfone, bis(4-hydroxyphenyl)ketone, bis(3-methyl-4-hydroxyphenyl)ketone, 3,3,3',3'-tetramethyl-6,6'-dihydroxyspiro(bis)indane, 3,3',4,4'-tetrahydro-4,4,4',4'-tetramethyl-2,2'-spirobi(2H-1-benzopyran)-7,7'-diol, trans-2,3-bis(4-hydroxyphenyl)-2-butene, 9,9-bis(4-hydroxyphenyl)fluorene, 9,9-bis(4-hydroxyphenyl)xanthene, 1,6-bis(4-hydroxyphenyl)-1,6-hexanedione, α,α,α',α'-tetramethyl-α,α'-bis(4-hydroxyphenyl)-p-xylene, α,α,α',α'-tetramethyl-α,α'-bis(4-hydroxyphenyl)-m-xylene, 2,6-dihydroxydibenzo-p-dioxin, 2,6-dihydroxythianthrene, 2,7-dihydroxyphenoxthine, 9,10-dimethyl-2,7-dihydroxyphenazine, 3,6-dihydroxydibenzofuran, 3,6-dihydroxydibenzothiophene, 4,4'-dihydroxybiphenyl, 1,4-dihydroxynaphthalene, 2,7-dihydroxypyrene, hydroquinone, resorcin, 4-hydroxyphenyl-4-hydroxybenzoate, ethyleneglycol-bis(4-hydroxybenzoate), diethyleneglycol-bis(4-hydroxybenzoate), triethyleneglycol-bis(4-hydroxybenzoate), p-phenylene-bis(4-hydroxybenzoate), 1,6-bis(4-hydroxybenzoyloxy)-1H,1H,6H,6H-perfluorohexane, 1,4-bis(4-hydroxybenzoyloxy)-1H,1H,4H,4H-perfluorobutane, 1,3-bis(4-hydroxyphenyl)tetramethyldisiloxane, and phenol-modified silicone oils. In addition, aromatic diol compounds which are prepared by reacting 2 moles of a diol with 1 mole of isophthloyl chloride or terephthaloyl chloride and which include an ester bond can also be used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Sixty and half (60.5) grams of a core/shell graft copolymer of an organopolysiloxane/acrylic complex rubber grafted with an acrylic monomer (tradenamed as Metablen SX-005 manufactured by Mitsubishi Rayon Co., Ltd.) were mixed with 500 ml of deionized water, and the mixture was agitated for 15 minutes using HOMO MIXER (MARK II) to wash the core/shell graft copolymer. This washing treatment was repeated 12 times while deionized water was changed in each washing treatment. The electroconductivity of the washing water in the last washing treatment was 1.75 μs/cm. The washed graft copolymer was then freeze-dried. Thus 58.2 grams of the washed graft copolymer were obtained. The thus washed graft copolymer was used for Examples 2 to 13.

Example 2

Preparation of Intermediate Layer

A polyamide resin (tradenamed as CM-8000 and manufactured by Toray Industries Inc.) was dissolved in a mixture solvent of methanol and butanol to prepare an intermediate layer coating liquid. The coating liquid was coated on an aluminum plate and then the coated liquid was dried to form an intermediate layer having a thickness of 0.3 μm.

Preparation of Charge Generation Layer

A bisazo compound having the following formula was dispersed in a mixture solvent of cyclohexane and 2-butanone using a ball mill to prepare a charge generation layer coating liquid.

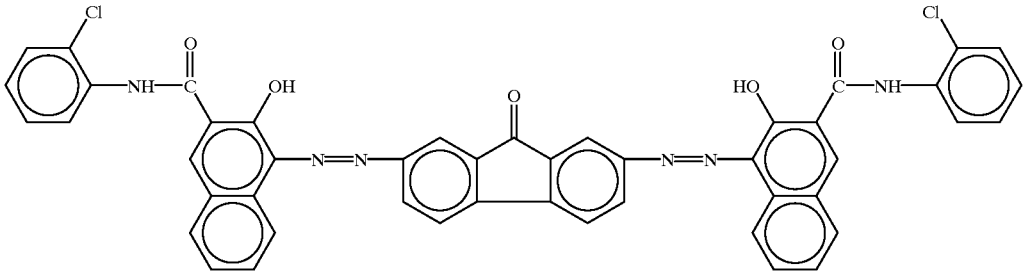

The coating liquid was coated on the intermediate layer using a doctor blade and then the coated liquid was dried to form a charge generation layer having a thickness of 0.5 μm.

Preparation of Charge Transport Layer

The following components were mixed and then dispersed for 3 hours using a ball mill.

Tetrahydrofuran 15.96 ml

Graft copolymer prepared in Example 1 0.012 g

Charge transport polymer material having the following formula 2.375 g (weight average molecular weight of 128000)

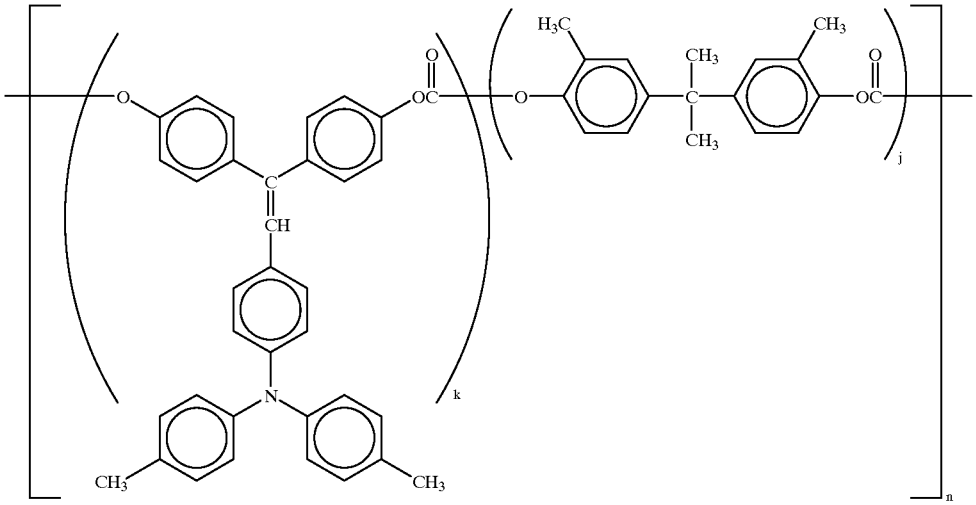

(random copolymer, wherein k=0.42 and j=0.58)

The thus prepared coating liquid was coated on the charge generation layer and the coated liquid was dried at room temperature. Then the coated layer was further dried at 120° C. for 20 minutes to form a charge transport layer having 20 μm.

The thus prepared photoreceptor was subjected to a corona discharging treatment of −6KV for 20 seconds in a dark place using a marketed electrostatic paper analyzer (tradenamed as SP428 manufactured Kawaguchi Electric Works) to measure a maximum surface potential Vm (V) of the photoreceptor.

After stopping charging, the charge photoreceptor was settled in the dark place for 20 seconds to measure a surface potential V0 (V), which was the surface potential on the photoreceptor at a time 20 seconds after the stop of charging.

Then a tungsten lamp irradiated the surface of the photoreceptor with light of 5.3 lux to measure a time at which the surface potential thereof became V0/2 (V). Thus an exposure amount E1/2 (lux·sec), which is defined as an exposure amount needed for decaying the surface potential from V0 to V0/2, was obtained.

The results are as follows:

Vm=−1414 V
V0=−1298 V
E1/2=1.11 lux·sec

Examples 3 and 4

The procedure for preparation and evaluation of the photoreceptor in Example 2 was repeated except that the weight ratio of the graft copolymer to the charge transport polymer was changed as shown in Table 1.

The results are also shown in Table 1.

TABLE 1

| | Weight ratio | | Electrostatic properties | | |
|---|---|---|---|---|---|
| | Graft polymer | Charge transport polymer | Vm (V) | V0 (V) | E½ (lux · sec) |
| Ex. 3 | 1 | 99 | −1427 | −1309 | 1.08 |
| Ex. 4 | 2 | 98 | −1381 | −1259 | 1.16 |

Example 5

Preparation of Intermediate Layer and Charge Generation Layer

The procedure for preparation of the intermediate layer and charge generation layer in Example 2 was repeated.

Preparation of Charge Transport Layer

The following components were mixed to prepare a polymer solution.

| | |
|---|---|
| Charge transport polymer used in Example 2 | 2.5 g |
| Tetrahydrofuran | 15.96 ml |

The solution was coated on the charge generation layer and the coated liquid was dried at room temperature to form a charge transport polymer layer of 10 μm.

Then the procedure for preparation of the charge transport layer coating liquid in Example 2 was repeated except that the weight ratio of the graft copolymer (Metablen SX-005) to the charge transport polymer was changed to 5/95. The charge transport layer coating liquid was coated on the charge transport polymer layer using a doctor blade, and the coated liquid was dried at room temperature and then further dried at 120° C. for 20 minutes to form a charge transport layer having a thickness of 10 μm.

The thus prepared photoreceptor was evaluated in the same way as performed in Example 2. The results are as follows:

Vm=−1422 V
V0=−1288 V
E1/2=1.08 lux·sec

Example 6

Preparation of Intermediate Layer and Charge Generation Layer

The procedure for preparation of the intermediate layer and charge generation layer in Example 2 was repeated.

Preparation of Charge Transport Layer

The following components were mixed and dispersed using a ball mill.

| | |
|---|---|
| Charge transport material having the following formula | 8.4 |

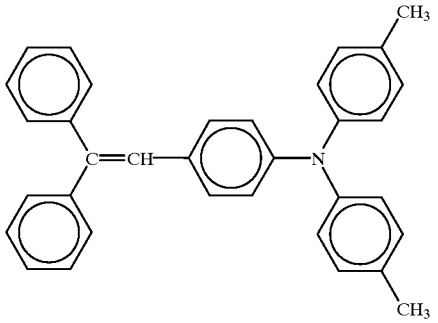

| | |
|---|---|
| Polycarbonate resin (tradenamed as Panlite TS2050 and manufactured by Teijin Ltd.) | 9.3 |
| Graft copolymer (Metablen SX-005) | 0.36 |
| Dichloromethane | 100 |

The coating liquid was coated on the charge generation layer and dried at room temperature to form a charge transport layer in which low molecular weight charge transport material is dispersed in a binder. The thickness of the charge transport layer was 20 μm.

The results are as follows:

Vm=−1330 (V)
V0=−1120 (V)
E1/2=0.70 lux·sec

Each of the photoreceptors of Examples 2 to 6 was set in a commercially available electrophotographic copier. In the copier, the photoreceptor was charged and exposed to imagewise light, which was reflected from an original document, to form an electrostatic latent image thereon. The latent image was developed with a dry toner to form a toner image. The toner image was transferred onto a receiving paper and then the toner image was fixed to produce a copy image.

All the images produced by the photoreceptors of Examples 2 to 6 had good image qualities.

When the latent images were developed using a liquid developer, the resultant images have good image qualities.

Example 7

The photoreceptor of Example 2 was subjected to a Taber abrasion test by a method based on JIS K7204(1995). The measuring conditions are as follows:

Measuring instrument: Taber Abrasion Tester (manufactured by Toyo Seiki Seisaku-Sho, Ltd.)
Abrasion wheel: CS-5
Time of abrasion: 3000 times
Load: 1 Kg The results are shown in Table 2.

Examples 8 to 11

The procedure for evaluation of photoreceptor in Example 7 was repeated except that the photoreceptor was changed to each of the photoreceptors of Examples 3 to 6.

The results are also shown in Table 2.

Comparative Example 1

Preparation of Photoreceptor

The procedure for preparation of the photoreceptor in Example 2 was repeated except that graft copolymer was not used in the charge transport layer coating liquid.

The photoreceptor was also evaluated in the same method as performed in Example 7.

The results are also shown in Table 2.

Comparative Examples 2 and 3

The procedure for preparation of the photoreceptor in Example 2 was repeated except that the graft polymer (Metablen SX-005) was replaced with a particulate polysiloxane (tradenamed as Torefil R-902A and manufactured by Toray Silicone Co., Ltd.) or a particulate crosslinked polystyrene (tradenamed as SX8742 (D)-05 and manufactured by Japan Synthetic Rubber Co., Ltd.) to prepare photoreceptors of Comparative Examples 2 and 3, respectively.

The photoreceptors were evaluated in the same way as performed in Example 7.

The results are also shown in Table 2.

Comparative Example 4

The procedure for preparation of the photoreceptor in Example 6 was repeated except that the graft copolymer was not used in the charge transport layer coating liquid.

The photoreceptors were evaluated in the same way as performed in Example 7.

The results are also shown in Table 2.

TABLE 2

| | Photoreceptor tested | Abrasion amount (mg) |
|---|---|---|
| Ex. 7 | Photoreceptor of Ex. 2 | 2.14 |
| Ex. 8 | Photoreceptor of Ex. 3 | 1.00 |
| Ex. 9 | Photoreceptor of Ex. 4 | 0.73 |
| Ex. 10 | Photoreceptor of Ex. 5 | 0.06 |
| Ex. 11 | Photoreceptor of Ex. 6 | 0.54 |
| Comp. Ex. 1 | Photoreceptor of Comp. Ex. 1 | 3.84 |
| Comp. Ex. 2 | Photoreceptor of Comp. Ex. 2 | 3.47 |
| Comp. Ex. 3 | Photoreceptor of Comp. Ex. 3 | 3.81 |
| Comp. Ex. 4 | Photoreceptor of Comp. Ex. 4 | 3.56 |

Figure 16:
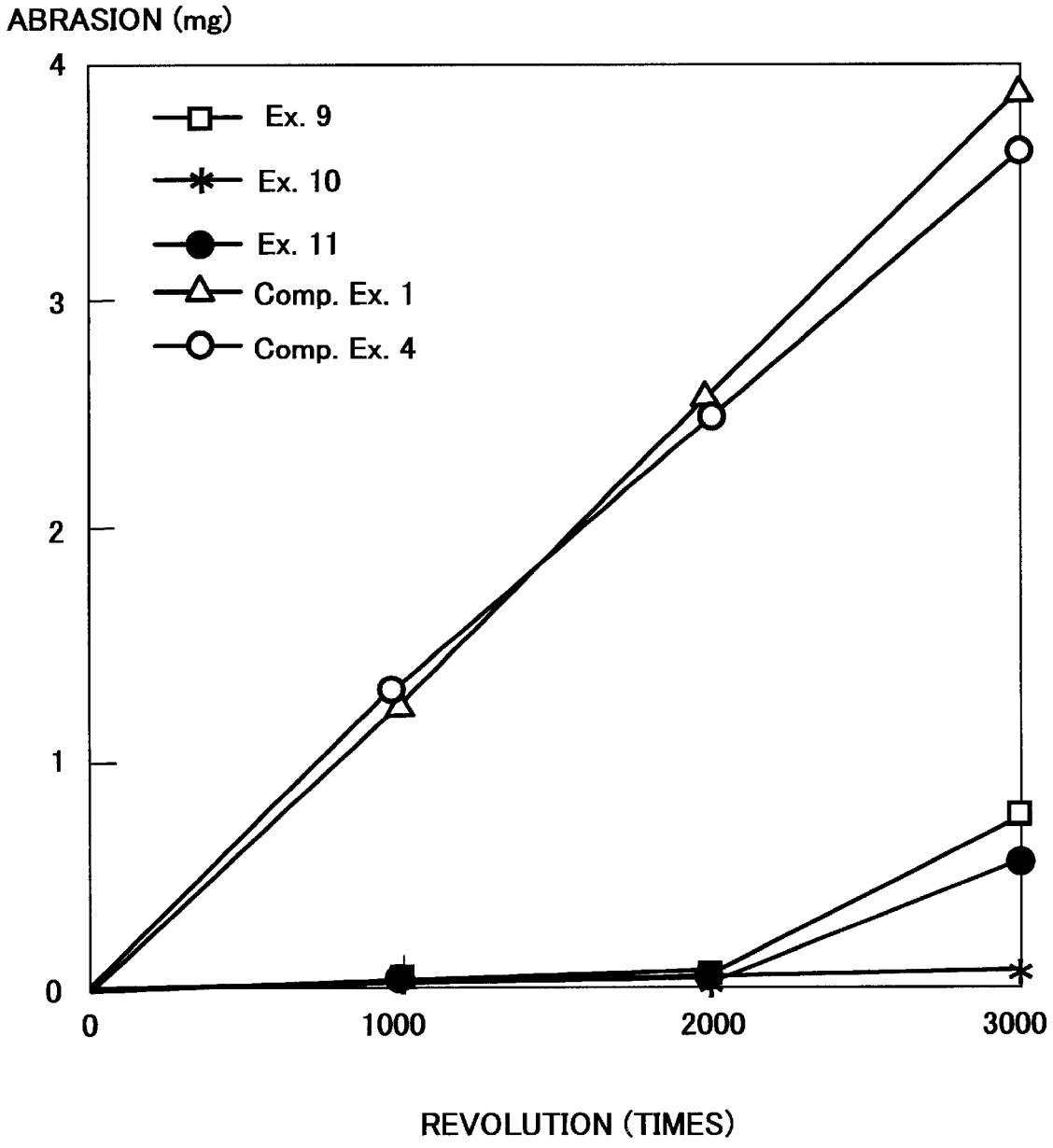
FIG. 16 is a graph illustrating the relationship between the amount of abrasion of the photosensitive layer of the photoreceptors prepared in Examples 9–11 and Comparative Examples 1 and 4 and revolution of the photoreceptors.

The relationship between the abrasion amounts of the photoreceptors of Examples 9, 10 and 11 and Comparative Examples 1 and 4 and revolution times are shown in FIG. 16.

As can be understood from the above description (evaluation results) and Table 2, the photoreceptor of the present invention has good electrophotographic properties such as high sensitivity and good abrasion resistance.

Example 12

The contact angle of the surface of the photoreceptor, which had been subjected to the abrasion test in Example 10, against pure water, was measured using an instrument AUTOMATIC CONTACT ANGLE METER manufactured by KYOWA INTERFACE SCIENCE CO., LTD.

In addition, the coefficient of static friction of the surface of the photoreceptor against a stainless ball was measured using an automatic friction and abrasion analyzer manufactured by KYOWA INTERFACE SCIENCE CO., LTD.

The results are shown in Table 3.

Example 13

The procedures for measurements of contact angle and static friction coefficient were repeated except that the photoreceptor was changed to the photoreceptor subjected to the abrasion test in Example 11.

The results are also shown in Table 3.

Comparative Examples 5 to 8

The procedures for measurements of contact angle and static friction coefficient were repeated except that the photoreceptor was changed to each of the photoreceptors subjected to the abrasion test in Comparative Examples 1 to 4.

The results are also shown in Table 3.

TABLE 3

| | Photoreceptor tested | Contact angle (°) | Static friction coeef. |
|---|---|---|---|
| Ex. 12 | Abraded photoreceptor of Ex. 5 | 99.66 | 0.15 |
| Ex. 13 | Abraded photoreceptor of Ex. 6 | 97.49 | 0.17 |
| Comp. Ex. 5 | Abraded photoreceptor of Comp. Ex. 1 | 83.41 | 0.43 |
| Comp. Ex. 6 | Abraded photoreceptor of Comp. Ex. 2 | 85.89 | 0.42 |
| Comp. Ex. 7 | Abraded photoreceptor of Comp. Ex. 3 | 86.00 | 0.44 |
| Comp. Ex. 8 | Abraded photoreceptor of Comp. Ex. 4 | 83.05 | 0.47 |

As can be understood from Table 3, the photoreceptor of the present invention has good water-repellent property and low static friction coefficient.

Example 14

The graft copolymer, Metablen SX-005, which had been subjected to the washing treatment in Example 1, was further subjected to a Soxhlet extraction treatment for 20 hours using methanol as a solvent. The graft copolymer was then dried at 70° C. for 20 hours. The contents of inorganic elements included in the graft copolymer were determined by Induced Coupled plasma Atomic Emission Spectroscopy.

The results are as follows:

Na: 1.3 ppm, Ca: 25 ppm, Ba: less than 1 ppm.

The contents of inorganic elements included in the graft copolymer, which had been subjected to the washing treatment in Example 1, were also determined. The results are as follows:

Na: 3.4 ppm, Ca: 560 ppm, Ba: less than 1 ppm.

Example 15

Preparation of Intermediate Layer and Charge Generation Layer

The procedure for preparation of the intermediate layer and charge generation layer was repeated to form the intermediate layer and charge generation layer on the aluminum plate.

Preparation of Charge Transport Layer

The following components were mixed and dispersed for 3 hours using a ball mill.

| | |
|---|---|
| Graft copolymer prepared in Ex. 14 | 0.125 g |
| Charge transport polymer used in Example 2 | 2.375 g |
| Dichloromethane | 10.69 ml |

This dispersion (i.e., the coating liquid) was coated on the charge generation layer, and the coated liquid was dried at room temperature followed by drying at 120° C. for 20 minutes. Thus, a charge transport layer having a thickness of 20 μm was prepared.

The electrostatic properties of the thus prepared photoreceptor were evaluated in the same way as performed in Example 2. The results are as follows:

Vm: −1579 V
V0: −1340 V
E1/2: 1.03 lux·sec

Example 16

The procedure for preparation of the photoreceptor in Example 6 was repeated except that the graft copolymer was replaced with the graft copolymer prepared in Example 14 and the polycarbonate resin was replaced with a polyarylate resin tradenamed as U-100 manufactured by UNITIKA CO., LTD. The electrostatic properties of the thus prepared photoreceptor were as follows:

Vm: −1557 V
V0: −1314 V
E1/2: 0.58 lux·sec

As can be understood from the above description, the image bearing material of the present invention includes a matrix resin, and a core/shell graft copolymer. The core/shell graft copolymer has a core which is a copolymer having a low friction coefficient and/or elasticity, and a shell which is a polymer having good compatibility with the matrix resin. Therefore, even when the image bearing material is repeatedly used, the function of the core can be maintained, namely, the image bearing material can maintain high abrasion resistance.

In particular, when the image bearing material is used in a photoreceptor, the resultant photoreceptor has excellent abrasion resistance.

This document claims priority and contains subject matter related to Japanese Patent Applications Nos. 11-367869, 2000-145652 and 2000-236849, filed on Dec. 24, 1999, May 17, 2000 and Aug. 4, 2000, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image bearing material comprising a matrix resin in a surface layer and, within said matrix resin, a core/shell graft copolymer, wherein said core/shell graft copolymer comprises a core comprising a one or more polymers and a shell comprising a graft polymer which has a linear chain connected with the core and which is formed from one or more monomers, and wherein said core/shell polymer is present at less than 20 weight % in said surface layer.

2. The image bearing material according to claim 1, wherein the linear chain of the graft polymer comprises a polar group.

3. The image bearing material according to claim 1, wherein the core comprises a complex polymer comprising two or more polymers which are intertwined with each other such that the polymers cannot be separated from the other, and wherein the one or more monomers comprises at least a vinyl monomer.

4. The image bearing material according to claim 3, wherein the two or more polymers have polymer networks, and wherein the polymer networks invade each other.

5. The image bearing material according to claim 3, wherein the two or more polymers comprise a polyorganosiloxane.

6. The image bearing material according to claim 3, wherein the complex polymer comprises an acrylic-silicone complex copolymer.

7. The image bearing material according to claim 3, wherein the complex polymer comprises a complex graft copolymer constituted of a polyorganosiloxane and at least one of polyalkyl acrylate and polyalkyl methacrylate.

8. The image bearing material according to claim 1, wherein the shell is constituted of one or more layers.

9. The image bearing material according to claim 1, wherein the core has at least one of a low coefficient of static friction and an elasticity.

10. The image bearing material according to claim 1, wherein the core/shell graft copolymer has been subjected to a washing treatment using deionized water to an extent such that the deionized water used for washing has an electroconductivity not greater than 5.0 μs/cm.

11. The image bearing material according to claim 1, wherein the core/shell graft copolymer has been refined by a solid-liquid extraction method.

12. The image bearing material according to claim 1, wherein the core/shell graft copolymer comprises sodium, calcium and barium each in an amount not greater than 100 ppm.

13. The image bearing material according to claim 1, wherein the core/shell graft copolymer has a volume average particle diameter of from 0.05 μm to 5.0 μm.

14. The image bearing material according to claim 1, wherein the core/shell graft copolymer is present in the matrix resin in an amount not greater than 20% by weight.

15. An electrophotographic photoreceptor comprising an electroconductive substrate and a photosensitive layer overlying the electroconductive substrate, wherein the photosensitive layer comprises a matrix resin in a surface layer and, within said matrix resin, a core/shell graft copolymer, and wherein the core/shell graft copolymer comprises a core, said core comprising one or more polymers and a shell comprising a graft polymer which has a linear chain connected with the core and which is formed from one or more monomers, and wherein said core/shell polymer is present at less than 20 weight % in said surface layer.

16. The electrophotographic photoreceptor according to claim 15, wherein the photosensitive layer further comprises a charge generation material and a charge transport material and comprises two or more layers, and wherein the matrix resin and the core/shell graft copolymer are included in a surface layer.

17. The electrophotographic photoreceptor according to claim 16, wherein the linear chain of the graft polymer comprises a polar group.

18. The electrophotographic photoreceptor according to claim 16, wherein the core comprises a complex polymer comprising two or more polymers which are intertwined with each other such that the polymers cannot be separated from one another, and wherein the one or more monomers comprises at least a vinyl monomer.

19. The electrophotographic photoreceptor according to claim 18, wherein the two or more polymers have polymer networks, and wherein the polymer networks invade each other.

20. The electrophotographic photoreceptor according to claim 18, wherein the two or more polymers comprise a polyorganosiloxane.

21. The electrophotographic photoreceptor according to claim 18, wherein the complex polymer comprises an acrylic-silicone complex copolymer.

22. The electrophotographic photoreceptor according to claim 18, wherein the complex polymer comprises a complex graft copolymer constituted of a polyorganosiloxane and at least one of polyalkyl acrylate and polyalkyl methacrylate.

23. The electrophotographic photoreceptor according to claim 16, wherein the shell is constituted of one or more layers.

24. The electrophotographic photoreceptor according to claim 15, wherein the core has at least one of a low coefficient of static friction and an elasticity.

25. The electrophotographic photoreceptor according to claim 16, wherein the core/shell graft copolymer has been subjected to a washing treatment using deionized water to an extent such that the deionized water used for washing has an electroconductivity not greater than 5.0 $\mu$s/cm.

26. The electrophotographic photoreceptor according to claim 16, wherein the core/shell graft copolymer has been refined by a solid-liquid extraction method.

27. The electrophotographic photoreceptor according to claim 16, wherein the core/shell graft copolymer comprises sodium, calcium and barium each in an amount not greater than 100 ppm.

28. The electrophotographic photoreceptor according to claim 16, wherein the core/shell graft copolymer has a volume average particle diameter of from 0.05 $\mu$m to 5.0 $\mu$m.

29. The electrophotographic photoreceptor according to claim 16, wherein the core/shell graft copolymer is present in the matrix resin in an amount not greater than 20% by weight.

30. The electrophotographic photoreceptor according to claim 16, wherein the photosensitive layer further comprises a charge generation layer comprising the charge generation material and a charge transport layer comprising the charge transport material.

31. The electrophotographic photoreceptor according to claim 30, wherein the charge transport layer is the surface layer, and wherein the charge transport layer comprises the core/shell graft copolymer and the matrix resin.

32. The electrophotographic photoreceptor according to claim 31, wherein the matrix resin comprises a charge transport polymer.

33. The electrophotographic photoreceptor according to claim 31, wherein the charge transport polymer is selected from the group consisting of polycarbonate resins, polyurethane resins, polyester resins, and polyether resins.

34. The electrophotographic photoreceptor according to claim 33, wherein the charge transport polymer has a triarylamine structure.

35. The electrophotographic photoreceptor according to claim 34, wherein the charge transport polymer comprises a polycarbonate resin having the following formula:

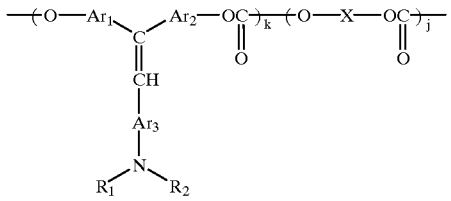

wherein Ar1, Ar2 and Ar3 independently represent a substituted or unsubstituted arylene group; R1 and R2 independently represent an acyl group, a substituted or unsubstituted alkyl group or a substituted or unsubstituted aryl group; k is an integer of from 5 to 5000 and j is an integer of from 5 to 5000, X represents a substituted or unsubstituted aliphatic divalent group, a substituted or unsubstituted alicyclic divalent group, a substituted or unsubstituted aromatic divalent group, or a group in which two or more of a substituted or unsubstituted aliphatic divalent group, a substituted or unsubstituted alicyclic divalent group, and a substituted or unsubstituted aromatic divalent group are combined, or a group having at least one of the following formulae:

(1-2)

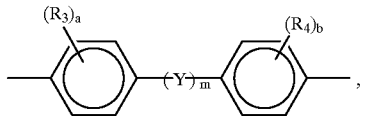

(1-3)

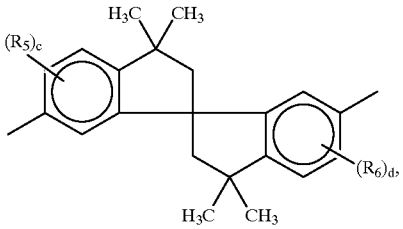

(1-4)

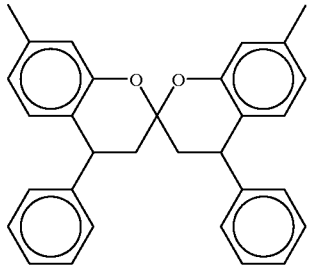

wherein R3, R4, R5 and R6 independently represent a substituted or unsubstituted alkyl group, a substituted or unsubstituted aryl group, or a halogen atom; a and b are independently 0 or an integer of from 1 to 4; c and d are independently 0 or an integer of from 1 to 3, wherein when any of a, b, c and d are greater than 1, the plural R3, R4, R5 or R6 groups may be the same as or different from one another; m is 0 or 1; Y represents a linear alkylene group having from 2 to 12 carbon atoms, a substituted or unsubstituted branched alkylene group having from 3 to 12 carbon atoms, a divalent group constituted of one or more alkylene groups having from 1 to 10 carbon atoms and at least one of an oxygen atom and a sulfur atom, —O—, —S—, —SO—, —$SO_2$—, —CO—, —COO—, or a group having one of the following formulae:

(1-5)

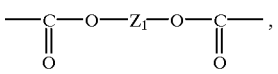

(1-6)

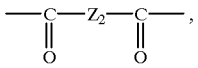

(1-7)

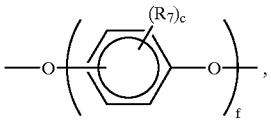

(1-8)

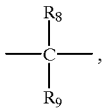

(1-9)

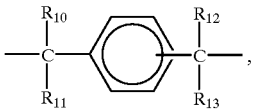

(1-10)

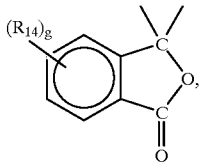

(1-11)

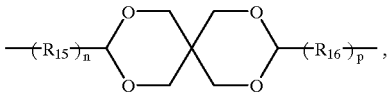

(1-12)

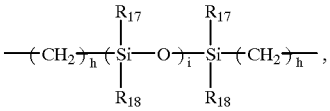

(1-13)

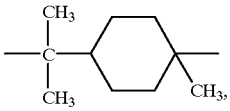

(1-14)

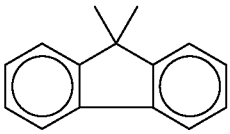

wherein Z1 and Z2 independently represent a substituted or unsubstituted aliphatic divalent group or a substituted or unsubstituted arylene group; R7 and R14 independently represent a halogen atom, a substituted or unsubstituted alkyl group, a substituted or unsubstituted alkoxyl group, or a substituted or unsubstituted aryl group; R8, R9, R10, R11, R12 and R13 independently represent a hydrogen atom, a halogen atom, a substituted or unsubstituted alkyl group, a substituted or unsubstituted alkoxyl group, or a substituted or unsubstituted aryl group, wherein R8 and R9 may be combined to form a ring having from 5 to 12 carbon atoms; R15 and R16 independently represent an alkylene group having from 1 to 4 carbon atoms, wherein n and p are independently 0 or 1; R17 and R18 independently represent a substituted or unsubstituted alkyl group, or a substituted or unsubstituted aryl group; and e and g are independently 0 or an integer of from 1 to 4, f is 1 or 2, h is 0 or an integer of from 1 to 20, and i is 0 or an integer of from 1 to 2000.

36. The electrophotographic photoreceptor according to claim 30, wherein the charge generation layer is the surface layer, wherein the charge generation layer comprises the core/shell graft copolymer and the matrix resin.

37. The electrophotographic photoreceptor according to claim 30, wherein the photosensitive layer further comprises a protective layer as a surface layer, and wherein the protective layer comprises the matrix resin and the core/shell graft polymer.

38. The electrophotographic photoreceptor according to claim 30, wherein the photosensitive layer further comprises a surface layer comprising a low molecular weight charge transport material, and wherein the surface layer comprises the core/shell graft polymer and the matrix resin.

39. The electrophotographic photoreceptor according to claim 30, wherein the photosensitive layer further comprises a surface layer comprising a charge transport polymer serving as the matrix resin, and wherein the layer comprises the core/shell graft polymer.

40. The electrophotographic photoreceptor according to claim 15, wherein the photosensitive layer further comprises a charge generation material and a charge transport material and comprises two or more layers, and wherein the matrix resin, the core/shell graft copolymer and a low molecular weight charge transport material are included in a surface layer.

41. The electrophotographic photoreceptor according to claim 15, wherein the photosensitive layer further comprises a charge generation material and a charge transport material and comprises two or more layers, and wherein the core/shell graft copolymer and a charge transport polymer serving as the matrix resin are included in a surface layer.

42. The electrophotographic photoreceptor according to claim 41, wherein the charge transport polymer is selected from the group consisting of polycarbonate resins, polyurethane resins, polyester resins, and polyether resins.

43. The electrophotographic photoreceptor according to claim 42, wherein the charge transport polymer has a triarylamine structure.

44. The electrophotographic photoreceptor according to claim 43, the charge transport polymer comprising a polycarbonate resin, wherein the polycarbonate resin has the following formula:

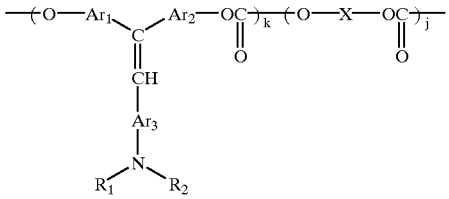

wherein Ar1, Ar2 and Ar3 independently represent a substituted or unsubstituted arylene group; R1 and R2 independently represent an acyl group, a substituted or unsubstituted alkyl group or a substituted or unsubstituted aryl group; k is an integer of from 5 to 5000 and j is an integer of from 5 to 5000, X represents a substituted or unsubstituted aliphatic divalent group, a substituted or unsubstituted alicyclic divalent group, a substituted or unsubstituted aromatic divalent group, or a group in which two or more of a substituted or unsubstituted aliphatic divalent group, a substituted or unsubstituted alicyclic divalent group, and a substituted or unsubstituted aromatic divalent group are combined, or a group having at least one of the following formulae:

(1-2)

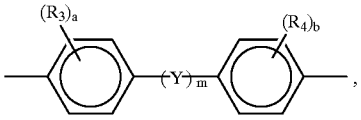

(1-3)

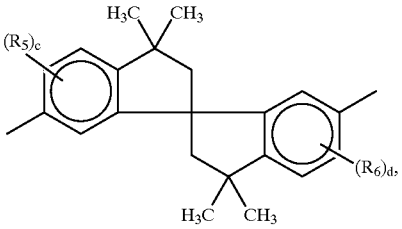

(1-4)

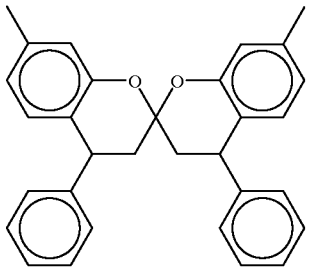

wherein R3, R4, R5 and R6 independently represent a substituted or unsubstituted alkyl group, a substituted or unsubstituted aryl group, or a halogen atom; a and b are independently 0 or an integer of from 1 to 4; c and d are independently 0 or an integer of from 1 to 3, wherein when R3, R4, R5 or R6 has plural groups, the plural groups may be the same as or different from the others; m is 0 or 1; Y represents a linear alkylene group having from 2 to 12 carbon atoms, a substituted or unsubstituted branched alkylene group having from 3 to 12 carbon atoms, a divalent group constituted of one or more alkylene groups having from 1 to 10 carbon atoms and at least an oxygen atom and a sulfur atom, —O—, —S—, —SO—, —SO2—, —CO—, —COO—, or a group having one of the following formulae:

(1-5)

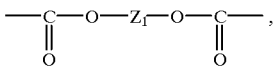

(1-6)

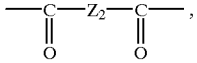

(1-7)

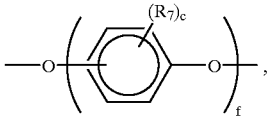

(1-8)

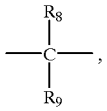

(1-9)

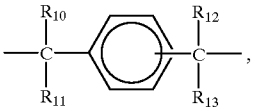

(1-10)

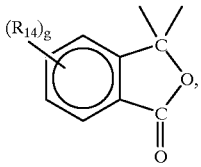

(1-11)

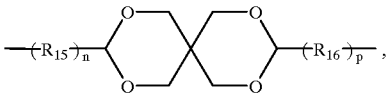

(1-12)

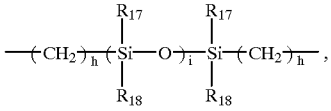

(1-13)

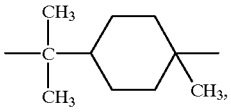

(1-14)

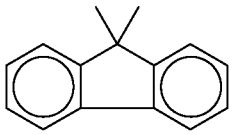

wherein Z1 and Z2 independently represent a substituted or unsubstituted aliphatic divalent group or a substituted or unsubstituted arylene group; R7 and R14 independently represent a halogen atom, a substituted or unsubstituted alkyl group, a substituted or unsubstituted alkoxyl group, or a substituted or unsubstituted aryl group; R8, R9, R10, R11, R12 and R13 independently represent a hydrogen atom, a halogen atom, a substituted or unsubstituted alkyl group, a substituted or unsubstituted alkoxyl group, or a substituted or unsubstituted aryl group, wherein R8 and R9 may be combined to form a ring having from 5 to 12 carbon atoms; R15 and R16 independently represent an alkylene group having from 1 to 4 carbon atoms, wherein n and p are independently 0 or 1; R17 and R18 independently represent a substituted or unsubstituted alkyl group, or a substituted or unsubstituted aryl group; and e and g are independently 0 or an integer of from 1 to 4, f is 1 or 2, h is 0 or an integer of from 1 to 20, and i is 0 or an integer of from 1 to 2000.

45. The electrophotographic receptor according to claim 15, wherein the photoreceptor has a surface having a contact angle of from 90° to 140° against pure water.

46. The electrophotographic receptor according to claim 15, wherein the photoreceptor has a surface having a coefficient of static friction of from 0.05 to 0.4.

47. An electrophotographic image forming apparatus comprising:

an electrophotographic photoreceptor;

a charging device configured to charge the photoreceptor;

a light irradiating device configured to irradiate the charged photoreceptor with light to form an electrostatic latent image on the photoreceptor;

a developing device configured to develop the electrostatic latent image with a toner to form a toner image on the photoreceptor;

a transfer device configured to transfer the toner image onto a receiving material; and a cleaning device configured to clean a surface of the photoreceptor, wherein the photoreceptor comprises an electroconductive substrate and a photosensitive layer overlying the electroconductive substrate, wherein the photosensitive layer comprises a matrix resin in a surface layer and, within the matrix resin, a core/shell graft copolymer, and wherein the core/shell graft copolymer comprises a core comprising one or more polymers and a shell comprising a graft polymer which has a linear chain connected with the core and which is formed from one or more monomers, and wherein said core/shell polymer is present at less than 20 weight % in said surface layer.

48. A process cartridge comprising:

an electrophotographic photoreceptor; and at least a device selected from the group consisting of:

a charging device configured to charge the photoreceptor;

a light irradiating device configured to irradiate the charged photoreceptor with light to form an electrostatic latent image on the photoreceptor;

a developing device configured to develop the electrostatic latent image with a toner to form a toner image on the photoreceptor;

a transfer device configured to transfer the toner image onto a receiving material; and a cleaning device configured to clean a surface of the photoreceptor, wherein the process cartridge can be attached to and detached from an electrophotographic image forming apparatus, wherein the photoreceptor comprises an electroconductive substrate and a photosensitive layer overlying the electroconductive substrate, wherein the photosensitive layer comprises a matrix resin in a surface layer and, within the matrix resin, a core/shell graft copolymer, and wherein the core/shell graft copolymer comprises a core comprising one or more polymers and a shell comprising a graft polymer which has a linear chain connected with the core and which is formed from one or more monomers, and wherein said core/shell polymer is present at less than 20 weight % in said surface layer.

49. An image bearing member on which an electrostatic latent image is to be formed, comprising an electroconductive substrate and a surface layer comprising a matrix resin in a surface layer and, within the matrix resin, a core/shell graft copolymer, wherein the core/shell graft copolymer comprises a core comprising one or more polymers and a shell comprising a graft polymer which has a linear chain connected with the core and which is formed from one or more monomers, and wherein said core/shell polymer is present at less than 20 weight % in said surface layer.

50. An intermediate transfer medium on which a toner image is to be formed, comprising an electroconductive substrate and a surface layer comprising a matrix resin in said surface layer and, within the matrix resin, a core/shell graft copolymer, wherein the core/shell graft copolymer comprises a core comprising one or more polymers and a shell comprising a graft polymer which has a linear chain connected with the core and which is formed from one or more monomers, and wherein said core/shell polymer is present at less than 20 weight % in said surface layer.

* * * * *